US011401745B2

(12) United States Patent
Capur et al.

(10) Patent No.: US 11,401,745 B2
(45) Date of Patent: Aug. 2, 2022

(54) FURNITURE HINGE HAVING A BLOCKING ELEMENT FOR A LINEAR DAMPER

(71) Applicant: SAMET KALIP VE MADEN ESYA SAN. VE TIC A.S., Istanbul (TR)

(72) Inventors: Ertac Capur, Beylikdüzü/Istanbul (TR); Ufuk Kiziltan, Istanbul (TR); Himmet Tanriverdi, Esenyurt/Istanbul (TR)

(73) Assignee: SAMET KALIP VE MADEN ESYA SAN. VE TIC A.S.

( * ) Notice: Subject to any disclaimer, the term of this patent is extended or adjusted under 35 U.S.C. 154(b) by 99 days.

(21) Appl. No.: 16/481,740

(22) PCT Filed: Feb. 13, 2017

(86) PCT No.: PCT/TR2017/000027
§ 371 (c)(1),
(2) Date: Jul. 29, 2019

(87) PCT Pub. No.: WO2018/147817
PCT Pub. Date: Aug. 16, 2018

(65) Prior Publication Data

US 2021/0277698 A1 Sep. 9, 2021

(51) Int. Cl.
*E05D 7/04* (2006.01)
*E05F 5/00* (2017.01)
(Continued)

(52) U.S. Cl.
CPC ..... *E05F 5/006* (2013.01); *E05D 11/10* (2013.01); *E05F 5/06* (2013.01); *E05Y 2201/212* (2013.01); *E05Y 2900/20* (2013.01)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 4,312,098 A 1/1982 Sundermeier
6,883,204 B2 4/2005 Salice
(Continued)

FOREIGN PATENT DOCUMENTS

CN 106193866 A 12/2016
DE 7924808 U1 11/1979
(Continued)

OTHER PUBLICATIONS

European Patent Office Action of corresponding patent application No. 17 711 378.4,dated Jan. 5, 2022, 5 pages (not prior art).
(Continued)

*Primary Examiner* — Chuck Y Mah
(74) *Attorney, Agent, or Firm* — Lucian Wayne Beavers; Patterson Intellectual Property Law, PC

(57) ABSTRACT

The invention relates to a furniture hinge for the articulated fastening of a furniture door, flap or the like to a furniture carcass, with a hinge body with a hinge cup and a hinge arm which is pivotably connected to the hinge cup and which can be fastened to one of the furniture parts, and with a mounting body which can be fastened to the other furniture part, with a linear damper for damping at least the closing movement of the furniture hinge, and with a blocking element which can be set in at least two switching positions and by means of which the linear damper is blocked in a blocking switching position in its inserted position and is released in a damping switching position, wherein, in the blocking switching position, a blocking bolt which is rotatably
(Continued)

mounted about an axis of rotation of the blocking element is pivoted into the actuating region of the linear damper or of a component connected to the linear damper and is pivoted out of the actuating region in the damping switching position. Here, there is provision that the axis of rotation of the blocking element is oriented in the direction of movement of the linear damper. The furniture hinge allows a secure setting of the damping action of the linear damper of the furniture hinge.

12 Claims, 11 Drawing Sheets

(51) Int. Cl.
*E05D 11/10* (2006.01)
*E05F 5/06* (2006.01)

(58) Field of Classification Search
CPC ..... E05Y 2201/21; E05Y 2201/261; E05Y 2201/11; E05Y 2201/258; E05Y 2201/46; E05Y 2201/474; E05F 5/006; E05F 5/02; E05F 5/027; E05D 11/0054; E05D 11/1021; E05D 11/1042; E05D 11/105; E05D 11/1064; E05D 7/04; E05D 7/0407; E05D 7/123; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 7,509,708 | B1 | 3/2009 | Radke et al. | |
| 7,552,509 | B2 * | 6/2009 | Chen | E05F 5/10 16/50 |
| 8,307,498 | B2 | 11/2012 | Krammer | |
| 8,561,262 | B1 * | 10/2013 | Liang | E05F 5/04 16/296 |
| 8,650,711 | B1 * | 2/2014 | Chen | E05F 5/006 16/296 |
| 8,991,010 | B2 * | 3/2015 | Brunnmayr | E05F 3/20 16/319 |
| 9,163,447 | B1 * | 10/2015 | Liang | E05F 5/006 |
| 9,366,067 | B2 * | 6/2016 | Wu | E05F 1/1215 |
| 9,874,049 | B1 * | 1/2018 | McGregor | E05D 5/065 |
| 2012/0167342 | A1 | 7/2012 | Wu et al. | |
| 2013/0145580 | A1 * | 6/2013 | Brunnmayr | E05F 5/02 16/84 |
| 2013/0160242 | A1 * | 6/2013 | Brunnmayr | E05F 5/02 16/85 |
| 2015/0068126 | A1 | 3/2015 | Forster et al. | |
| 2015/0337578 | A1 * | 11/2015 | Peer | E05D 15/00 16/307 |
| 2016/0138319 | A1 * | 5/2016 | Wu | E05D 3/02 16/50 |
| 2017/0107749 | A1 * | 4/2017 | McGregor | E05F 5/006 |
| 2017/0152694 | A1 * | 6/2017 | Chen | E05F 5/10 |
| 2018/0328093 | A1 * | 11/2018 | Zimmer | E05F 5/02 |

FOREIGN PATENT DOCUMENTS

| | | | | |
|---|---|---|---|---|
| EP | 1367203 | A2 | 12/2003 | |
| EP | 1688572 | A2 | 8/2006 | |
| EP | 2766547 | A1 | 8/2014 | |
| GB | 2529250 | A * | 2/2016 | E05D 11/0054 |
| WO | 9845560 | A1 | 10/1998 | |
| WO | 2009124332 | A1 | 10/2009 | |
| WO | 2013149632 | A1 | 10/2013 | |
| WO | WO-2015155579 | A1 * | 10/2015 | E05F 5/006 |

OTHER PUBLICATIONS

Co-Pending U.S. Appl. No. 16/481,737, filed Feb. 13, 2017 (not prior art).
International Search Report for corresponding PCT/TR2017/000027 dated Oct. 18, 2017, 11 pages (not prior art).

* cited by examiner

FURNITURE HINGE HAVING A BLOCKING ELEMENT FOR A LINEAR DAMPER

BACKGROUND OF THE INVENTION

Field of the Invention

The invention relates to a furniture hinge for articulated fixing of a furniture door, flap or the like to a furniture carcass, having a hinge member having a hinge cup and a hinge arm which is pivotably connected to the hinge cup and which can be secured to one of the furniture components, and having an assembly member which can be secured to the other furniture component, having a linear damper for damping at least the closure movement of the furniture hinge, having a locking element which can be adjusted into at least two switching positions and by means of which the linear damper is blocked in a locking switching position in the retracted position thereof and is released in a damping switching position, wherein in the locking switching position a locking bolt which is pivotably supported about a rotation axis of the locking element is pivoted into the adjustment region of the linear damper or a component which is connected to the linear damper and in the damping switching position is pivoted out of the adjustment region.

Description of the Prior Art

WO 2013/149632 A1 discloses a damping element for installation in a hinge cup of a furniture hinge. A resiliently tensioned damper cylinder may be introduced into the adjustment path of a portion of the furniture hinge and a closure movement of the furniture hinge may thereby be damped. The adjustment region and consequently the damping action of the damping element may be adjusted by means of an adjustment element which is intended to be operated without tools, for example, in predetermined stages. To this end, a blocking portion of the adjustment element is adjusted in terms of its position in such a manner that a stop, which is connected to the damping cylinder and which is moved therewith when the damping cylinder is deployed into a first position of the adjustment element, strikes the blocking portion and is thereby secured and in a second position is not. Depending on the position of the blocking portion, the adjustment region and consequently the damping action of the damping element is accordingly limited. The blocking portion and the stop are constructed in such a manner that the damping cylinder can also be inserted in the first position of the adjustment element. When the furniture hinge is opened, the stop then strikes the blocking portion of the adjustment element and the damping cylinder is not or only partially deployed. WO 2013/149632 A1 sets out two construction variants for the adjustment element. In a first construction variant, the adjustment element is constructed as a rotary arrangement having an operating portion and blocking portion which can be adjusted about a rotation axis. In this instance, the rotation axis is orientated perpendicularly to the movement direction of the damper cylinder and consequently of the stop. The blocking portion is consequently screwed in on a circular path in the movement direction of the damper cylinder in the adjustment path of the stop. The resilient force for deployment of the damper cylinder is consequently transmitted from the stop in an actuation direction of the adjustment element to the blocking portion. There must be provided corresponding locking devices which prevent unintentional adjustment of the adjustment element as a result of the active resilient force from the first position thereof in the direction of the second position thereof. In particular with a cost-effective production of the damping element or the locking devices of plastics material and repeated actuation of the adjustment element, the locking devices may become worn so that a secure fixing of the damping cylinder counter to the acting resilient force is no longer possible. A reduction of the damping action of the furniture hinge is then no longer possible. In a second construction variant for the adjustment element, WO 2013/149632 A1 proposes a linearly adjustable sliding element, wherein a portion of the sliding element can be inserted into the adjustment path of the stop of the damping cylinder transversely relative to the movement direction thereof. The movement directions of the adjustment element and the damping cylinder are accordingly orientated transversely relative to each other, whereby an unintentional adjustment of the sliding element is reliably prevented by the resilient force acting on the stop. However, such a sliding element has a tendency to become caught during adjustment. There is thereby less operating comfort compared with a rotary actuation.

WO 2009/124332 A1 sets out a damping device for a furniture fitting. A curved actuation element is arranged in a hinge cup so as to be supported in a pivotable manner about a rotation axis. The rotation axis is in this instance orientated in accordance with the pivot axis of the furniture hinge. A rotor and a rotation damper are connected to the actuation element laterally and opposite. Both act in a pivot direction of the actuation element. The actuation element is introduced into the adjustment path of an articulated lever of the furniture hinge and is pivoted thereby about the rotation axis thereof when the furniture hinge is folded in. The pivot movement is in this instance damped by the rotation damper. As a result of the rotor, a resilient force opposed to the closure movement is transmitted to the actuation element. When the furniture hinge is folded open, the actuation element is thereby adjusted again into the original position thereof into the adjustment path of the articulated lever. The rotor has at the periphery thereof recesses in which a securing element can be inserted by means of a linear sliding member. The adjustment path of the actuation element can thereby be limited. The embodiment of the damping device with a rotation damper and a rotor is complex and accordingly cost-intensive.

EP 2 766 547 B1 discloses a furniture hinge with a linear damper and a return spring. The damper and the return spring counteract a closure of the furniture hinge. They are constructed separately and act on a common sliding member which is introduced into the adjustment path of a hinge arm. The expansion of the spring can be blocked by means of a blocking element. This element is, for example, constructed as a sliding element. The blocking element may also be constructed as a hook which can be pivoted about an axis which is orientated transversely relative to the movement direction of the return spring and when actuated engages in the windings of the spring.

SUMMARY OF THE INVENTION

An object of the invention is to provide a damped furniture hinge which enables reliable switching on and switching off of the damping effect.

The object of the invention is achieved by the rotation axis of the locking element being orientated in the movement direction of the linear damper. The locking bolt of the locking element is consequently pivoted transversely relative to the movement direction or active direction of the linear damper into the adjustment region of the linear damper or the component which is connected to the linear damper. Opening forces of the linear damper orientated in the direction of the deployed position of the linear damper thereby act transversely relative to the adjustment direction of the locking bolt. No forces acting in the adjustment direction of the locking element are consequently transmitted from the linear damper to the locking bolt. The switching position of the locking element therefore cannot be unintentionally adjusted by the linear damper.

A simple and rapid adjustment of the switching position of the locking element can thereby be enabled by the locking element being intended to be adjusted without tools.

According to a preferred construction variant of the invention, there may be provision for the locking element to have a rotary member which is supported so as to be able to be rotated about the rotation axis of the locking element and on which the locking bolt and, in a state offset angularly relative thereto, a handle are secured, preferably formed on. The locking element may thus be orientated to face the linear damper, whilst the handle is orientated for easily accessible operation of the locking element. As a result of the coupling of the locking bolt and the handle to the rotary member, an actuation of the handle is transmitted directly to the locking bolt.

Preferably, there may be provision for the rotary member to be supported on a bearing pin in such a manner that the bearing pin is supported in a locking element housing and the locking bolt and the handle are guided through openings out of the locking element housing. A mechanically protected and nonetheless simple construction of the locking element is thereby produced. This element can be assembled in a simple manner as a structural unit on a furniture hinge. In a particularly preferred manner, the rotary member, the locking bolt and the handle are constructed integrally, for example, as a plastics material component which can be produced in a cost-effective manner.

In order to prevent unintentional adjustment of the locking element by a user and to enable a precise adjustment of the switching positions, there may be provision for the rotation of the locking bolt to be locked in the switching positions of the locking element by means of at least one locking device.

A precise orientation and securing of the locking element to a furniture hinge is enabled by the locking element housing having at least one locking attachment by means of which the locking element housing can be secured to the hinge cup of the furniture hinge. It is consequently ensured that the locking bolt is orientated in accordance with the respective switching position thereof in a precise manner relative to the linear damper.

According to a preferred construction variant of the invention, there may be provision for the locking bolt to have an inclined start-up member and opposite a blocking face, in the locking switching position and with the linear damper deployed for the inclined start-up member to be orientated so as to be facing the linear damper or the component which is connected to the linear damper and, in the locking switching position and with the linear damper retracted, for the blocking face to be orientated so as to face the linear damper or the component which is connected to the linear damper. Preferably, there may further be provision for a blocking attachment to be secured to a movably supported cylinder or a movably supported piston of the linear damper, for the blocking attachment to have an attachment inclination and opposite a blocking counter-face, in the locking switching position and with the linear damper deployed, for the attachment inclination to be orientated to face the locking bolt and, in the locking switching position and with the linear damper retracted, for the blocking counter-face to be orientated so as to face the locking bolt. The locking element can be actuated with the furniture door, flap or the like open. Starting from the damping switching position of the locking element, the linear damper is then deployed. By switching the locking element into its locking switching position, the locking bolt is pivoted into the movement path of the blocking attachment. During subsequent closure of the furniture door, flap or the like and consequently of the furniture hinge, the linear damper is pushed together. In this instance, the blocking attachment with the attachment inclination thereof strikes the inclined start-up member of the locking bolt. The attachment inclination and the inclined start-up member form sliding faces along which the blocking attachment slides past the locking bolt. When the retracted end position of the linear damper is reached, the blocking attachment and the locking bolt are arranged laterally with respect to each other in such a manner that the blocking face of the locking bolt abuts the blocking counter-face of the blocking attachment. Sliding out the linear damper during the next opening of the furniture door, flap or the like and consequently of the furniture hinge is thereby blocked. The blocking face and the blocking counter-face are preferably orientated transversely relative to the movement direction of the linear damper and consequently the blocking attachment. The linear damper is thereby prevented in the locking switching position from being able to slide past the locking bolt from the retracted position thereof or the locking element is prevented from being displaced into the damping switching position thereof as a result of the restoring forces transmitted from the linear damper to the locking bolt. The formation of the locking bolt and the blocking attachment make it possible for the locking element to be able to be operated with the furniture door, flap or the like open, the linear damper also to be able to be retracted in the locking switching position of the locking element and the linear damper to be retained securely in the retracted position thereof when the furniture door, flap or the like is next opened.

If there is provision for the locking bolt to be constructed resiliently at least in the pivot direction of the locking element, the locking bolt in the locking switching position can thus be pressed to the side when the linear damper is retracted by the attachment inclination and inclined start-up member sliding past each other. The path is thereby released so that the blocking attachment can be guided past the locking bolt and consequently the linear damper can be adjusted into the retracted end position thereof. When the end position of the linear damper is reached, the locking bolt returns as a result of the resilience thereof into its original position again so that the blocking face thereof abuts the blocking counter-face of the blocking attachment.

According to a preferred embodiment of the invention, there may be provision for the linear damper to be at least partially arranged and guided in a housing, for the hinge cup of the furniture hinge to have an assembly region which is reduced in terms of the cup depth thereof and which is terminated at the base side by a cover, for the housing in the assembly region to be secured from the outer side to the cover of the hinge cup, for a movably supported portion of the linear damper to be guided through an opening into the inner region of the hinge cup and the pivot region of the hinge arm of the furniture hinge and for the locking element to be secured in a recess of the cover in such a manner that the handle of the locking element is arranged in the inner region and the locking bolt is arranged in the outer region of the hinge cup. The linear damper is thus arranged outside the hinge cup and consequently protected. The inner space of the hinge cup is free and can thereby be easily cleaned. The locking element can be operated from the inner space of the hinge cup and engages outside the hinge cup in the adjustment path of the linear damper or the blocking attachment which is connected to the linear damper.

There is provision for the housing facing the locking element to have a wall recess through which the locking bolt is guided into the housing, the movable components of the linear damper and preferably also of the locking element are thus protected in each case and arranged so as to be able to be easily mounted in housings. The locking bolt can be introduced through the wall recess into the adjustment path of the damper.

A simple assembly of the furniture door, flap or the like on the furniture carcass can be achieved by the hinge arm being able to be indirectly or directly secured to the assembly member by means of a connection system which is intended to be closed without tools. The hinge arm with the hinge cup can thereby be secured, for example, to the furniture door, flap or the like and the assembly member to the furniture carcass. The actual assembly of the furniture door, flap or the like to the furniture carcass is then carried out without tools. A fitter consequently does not have to guide any tool and has both hands free for the assembly of the furniture door, flap or the like. Since he preferably also requires no tool for the adjustment of the switching position of the locking element, the assembly of the furniture door and adjustment of the damping can be carried out in a simple and rapid manner.

BRIEF DESCRIPTION OF THE DRAWINGS

The invention is explained in greater detail below with reference to an embodiment illustrated in the drawings:

In the drawings:

FIG. 6 is an exploded view of a hinge member having a hinge cup for securing the furniture hinge to a furniture door, flap or the like;

DETAILED DESCRIPTION

Figure 1:
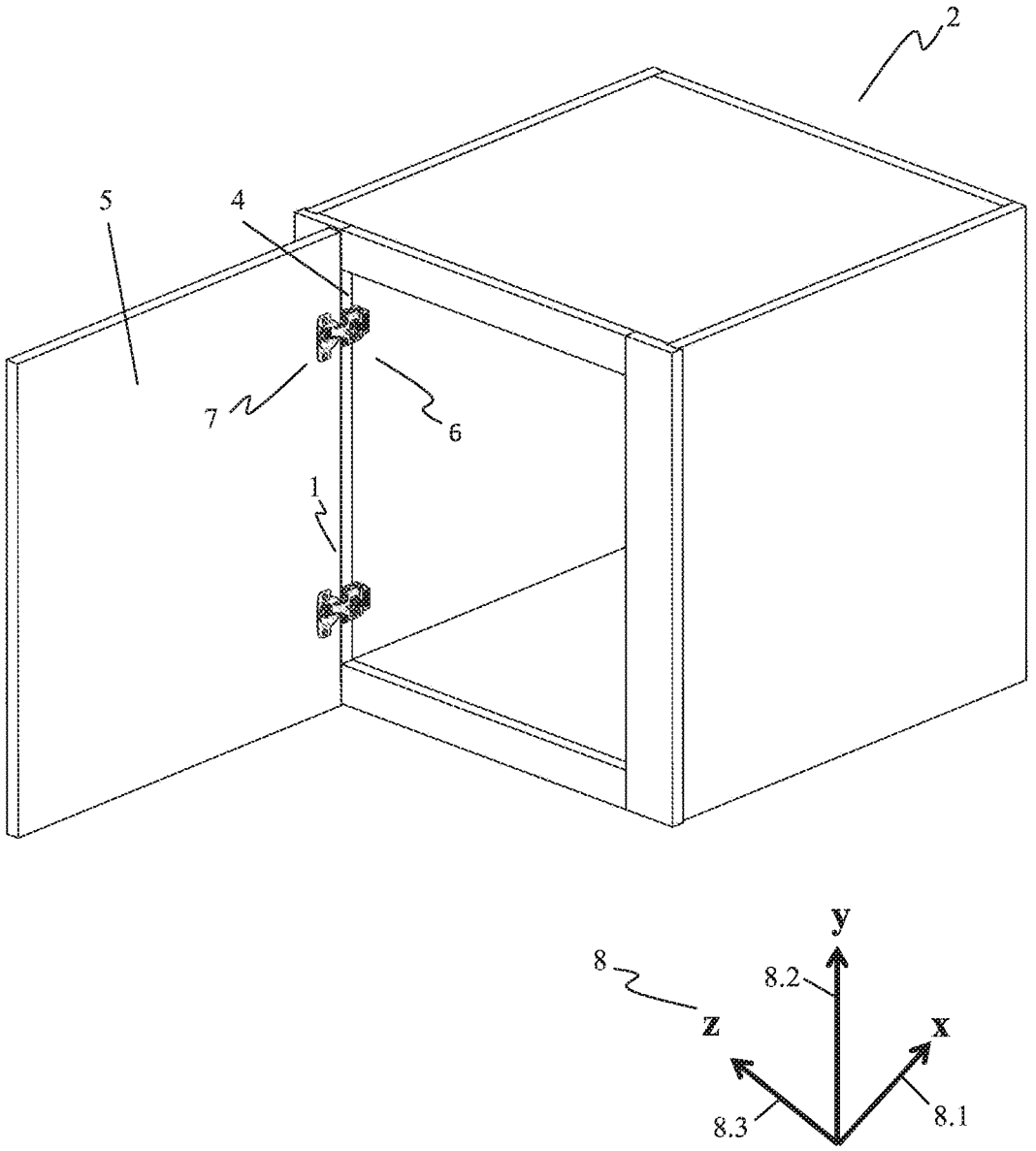
FIG. 1 is a perspective view of an item of furniture with an articulated furniture door.

FIG. 1 is a perspective view of an item of furniture 2 having an articulated furniture door 5. It is conceivable in place of the furniture door 5 to also provide a flap or other furniture component which is connected to the item of furniture 2 so as to be able to be folded. The furniture door 5 or the flap or other furniture component may also be referred to as a pivoted furniture part 5. The furniture door 5 is secured with two furniture hinges 1 to a frame 4 of a furniture carcass 3. An assembly member 6 and a hinge member 7 are associated with each furniture hinge 1. The hinge member 7 is connected to the furniture door 5. The assembly member 6 is secured to the frame 4. In this instance, the assembly member 6 is secured to the end side of the frame 4. Such a form of assembly is also known as Face Frame and is in particular used in the US American market. The furniture hinges 1 enable the furniture door 5 to be opened and closed in a pivoting movement.

A coordinate system 8 shows, with respect to the orientation of the item of furniture 3, three spatial directions, that is to say, an x direction 8.1, a y direction 8.2 and a z direction 8.3. The spatial directions indicate possible adjustment directions of the furniture door 5, as enabled by the furniture hinges 1.

Figure 2:
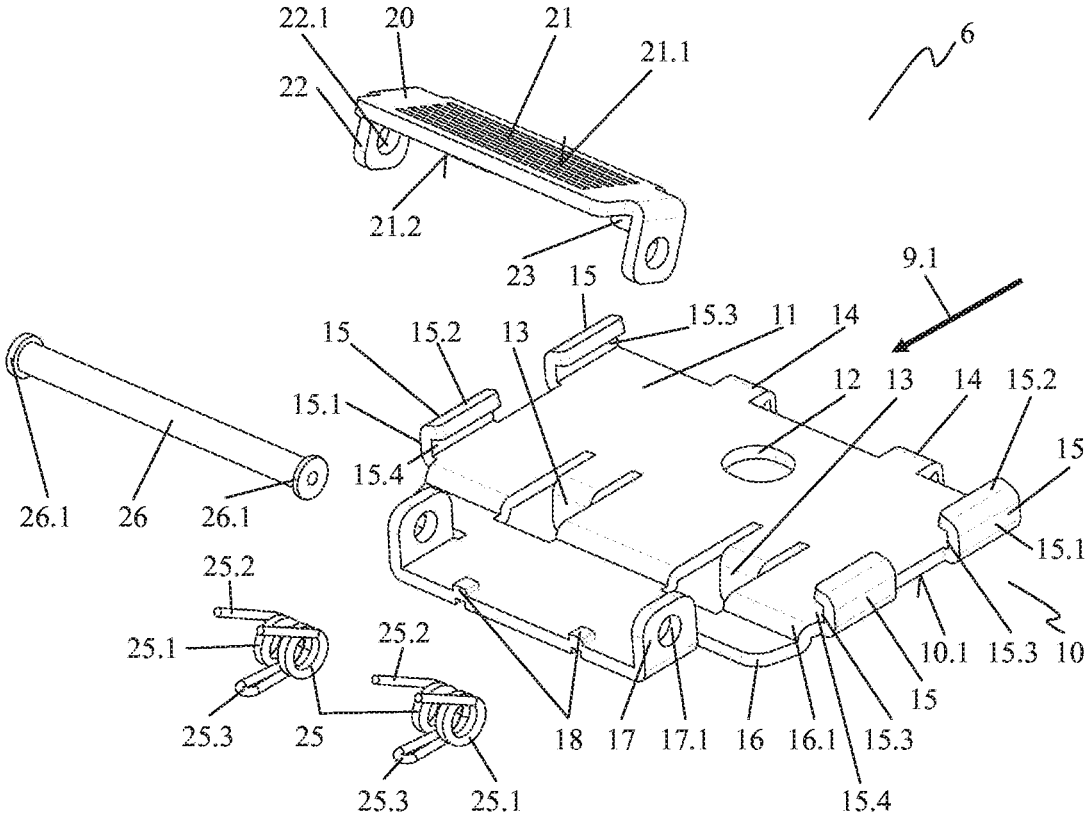
FIG. 2 is an exploded illustration of an assembly member for securing the furniture hinge to a furniture carcass.

FIG. 2 is an exploded view of the assembly body 6 for securing the furniture hinge 1 to the furniture carcass 3. A base carrier 10 and a blocking element 20 are associated with the assembly member 6.

The base carrier 10 serves to secure the assembly body 6 to the item of furniture 2 shown in FIG. 1. It is preferably constructed for this purpose as a punched component, in particular as a punched metal sheet component. An assembly portion 11 of the assembly member 6 is constructed in a plate-like manner. It has a recess 12. Facing away from the viewer, the base carrier 10 forms in the region of the assembly portion 11 an assembly face 10.1. The assembly face 10.1 is delimited by two inner stops 13 and two outer stops 14, which face each other in an assembly direction 9.1 illustrated by an arrow. The stops 13, 14 are constructed as angled flaps which are formed on the assembly portion 11. They are orientated in such a manner that they protrude beyond the assembly face 10.1.

Laterally and opposite each other, two lateral guides 15 are formed on the assembly portion 11 of the base carrier 10 in each case. The lateral guides 15 are in this instance arranged along the edges of the assembly portion 11 arranged transversely relative to the assembly direction 9.1. They are angled with respect to the assembly portion 11 and orientated so as to face away from the assembly face 10.1. At the end side, the lateral guides 15 are angled in such a manner that the terminal edges of the lateral guides 15 which are arranged opposite each other face each other. The lateral guides 15 consequently form in each case a lateral portion 15.1 and a covering portion 15.2 which is formed thereon, which portions, together with the assembly portion 11, in each case surround a guiding groove 15.4. The lateral guides 15 opposite guiding grooves 15.4 face each other. They form a sliding guide 15.3. The sliding guide 15.3 is orientated in the assembly direction 9.1.

Via a graduation 16.1, a retention attachment 16 is secured to the assembly portion 11. The retention attachment 16 is formed outside the region delimited by the stops 13, 14 on the assembly portion 11. Two retention webs 17 are formed laterally on the retention attachment 16. The retention webs 17 are constructed as flaps which are angled with respect to the retention attachment 16. Preferably, the retention webs 17 are arranged at an angle of 90° with respect to the retention attachment 16. They are in this instance angled in the direction facing away from the assembly face 10.1. The surface normals of the retention webs 17 are orientated transversely relative to the assembly direction 9.1. Each of the retention webs 17 is penetrated by an axial hole 17.1. The axial holes 17.1 of the retention webs 17 which are arranged opposite each other are orientated in alignment with each other. In the region between the retention webs 17, burled spring guides 18 are formed on the edge of the retention attachment 16.

Figure 5:
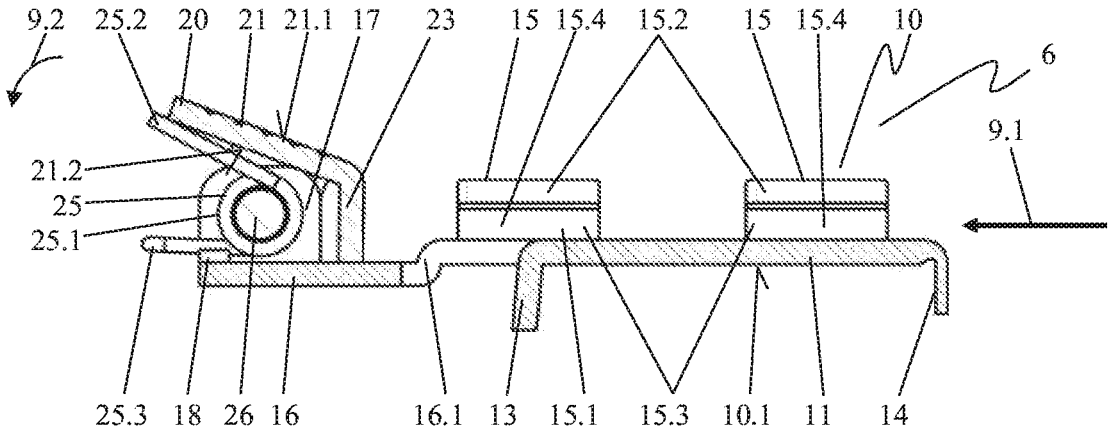
FIG. 5 is a lateral sectioned illustration of the assembly member shown in FIG. 3.

The blocking element 20 is constructed in a curved manner. It has a planar actuation portion 21 on which laterally angled articulated portions 22 are formed. In the articulated portions 22, an axle receiving member 22.1 in the form of a hole is introduced in each case. The axle receiving members 22.1 are orientated in alignment with each other. The articulated portions 22 are orientated in such a manner that with the assembly member 6 mounted, they are arranged laterally and with slight spacing relative to the retention webs 17 of the base carrier 10. The axle receiving members 22.1 are then orientated in alignment with the axial holes 17.1 of the retention webs 17. In a state concealed or partially concealed by the actuation portion 21, retention portions 23, as shown in FIG. 5, are formed on the actuation portion 21. The retention portions 23 are in this instance arranged on the edge of the actuation portion 21 orientated counter to the assembly direction 9.1. They are constructed in the form of flaps and angled with respect to the actuation portion 21 in the direction of the retention attachment 16. It is also conceivable to provide a continuous retention portion 23 along the edge of the actuation portion 21. The actuation portion 21 forms at the side thereof facing away from the retention attachment 16 an actuation side 21.1 and opposite it a resilient abutment face 21.2. In order to improve the sensation, the actuation side 21.1 has a structured surface.

An axle 26 is further associated with the assembly member 6. The axle 26 has at the end sides stops in the form of expansions 26.1. In this instance, at least one of the expansions 26.1 is fitted only during the assembly of the assembly member 6.

Two springs 25 are associated with the blocking element 20. The springs 25 each have an angled region 25.1 which is connected to a resilient curved member 25.3. The ends of the springs 25 are constructed as legs 25.2. The legs 25.2 of the springs 25 are orientated in the direction of the spring abutment face 21.1 of the blocking element 20 and the curved resilient member 25.3 in the direction of the surface of the retention attachment 16.

Figure 3:
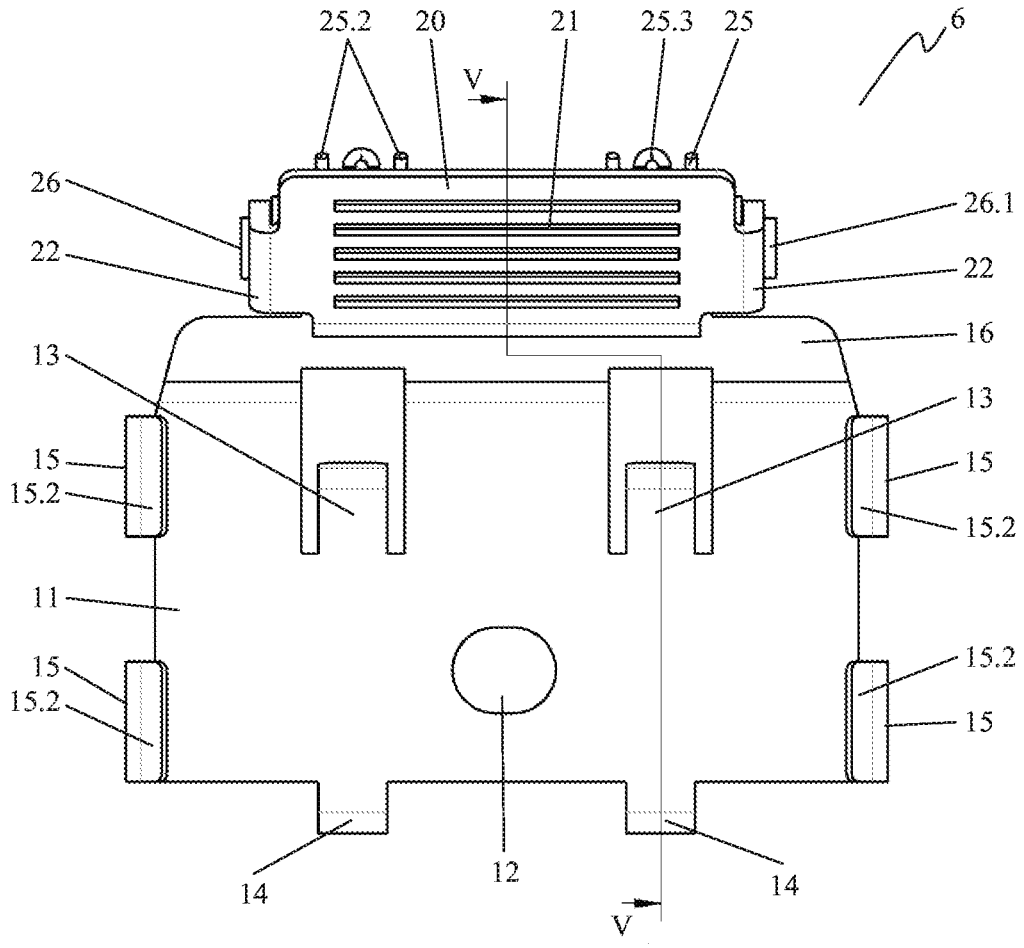
FIG. 3 is a plan view of the assembled assembly member shown in FIG. 2.

FIG. 3 is a plan view of the assembled assembly member 6 shown in FIG. 2. The same components are designated as introduced in relation to FIG. 2. The blocking element 20 is pivotably connected by means of the axle 26 to the base carrier 10 of the assembly member 6. To this end, as can clearly be seen in FIG. 4, the articulated portions 22 are arranged laterally outside the retention webs 17 and the axle 26 is inserted through the now aligned axle receiving members 22.1 and axial holes 17.1, as shown in FIG. 2. At the end side, the expansions 26.1 are formed on the axle 26 so that they cannot unintentionally be pushed out of the axial holes 17.1 and axle receiving members 22.1. The axle 26 thus forms a rotation axis for the blocking element 20. This axis is arranged in the assembly direction 9.1 in extension of the sliding guide 15.3 The springs 25 are inserted in a pretensioned state between the spring abutment face 21.2 of the actuation portion 21 as shown in FIG. 2 and the opposing side of the retention attachment 16 of the base carrier 10. They consequently press the blocking element 20 into the closure position thereof. In this closure position, the blocking element 20 abuts the retention attachment 16 with the retention portions 23 shown in FIG. 2.

Figure 4:
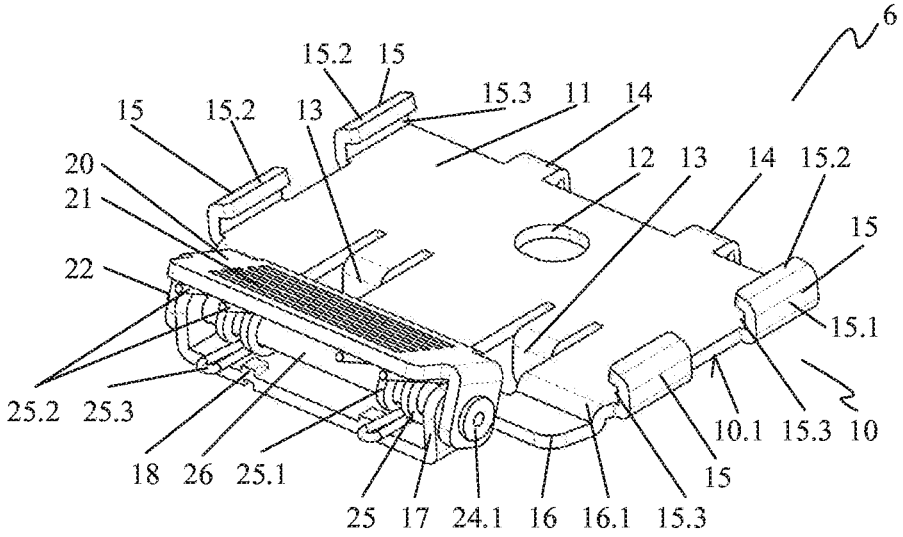
FIG. 4 is a perspective view of the assembly member shown in FIG. 3.

With reference to the description relating to FIG. 3, FIG. 4 is a perspective view of the assembly member 6 shown in FIG. 3. In this perspective view, the arrangement of the springs 25 can be clearly seen. The curved resilient members 25.3 abut at the side of the retention attachment 16 facing the blocking element 20. They are guided laterally through the spring guides 18 formed on the retention attachment 16. The legs 25.2 of the springs 25 abut the spring abutment face 21.2 of the actuation portion 21 of the blocking element 20. As a result of the pretensioning of the springs 25, the blocking element 20 is adjusted into the closure position thereof.

FIG. 5 is a lateral sectioned illustration of the assembly member 6 shown in FIG. 3. In this instance, the path of the section follows the line of section indicated V in FIG. 3. The base carrier 10 has in the assembly portion 11 thereof the assembly face 10.1, with which the assembly member 6 abuts the furniture carcass 3 when the furniture hinge 1 is assembled. The inner and outer stops 13, 14 are formed on the assembly portion 11 and protrude over the assembly face 10.1. The assembly face 10.1 is consequently delimited by the stops 13, 14. The assembly member 6 can thus be placed with the assembly face 10.1 on the frame 4 of a furniture carcass 3 and can using at least two of the stops 13, 14 be orientated relative thereto. The lateral guides 15 are formed laterally on the base carrier 10. The guiding grooves 15.4 are in this instance orientated in the direction toward the assembly portion 11. Together with the opposing lateral guides 15 and the assembly portion 11, the guiding grooves 15.4 form a sliding guide 15.3 This is orientated in the assembly direction 9.1 The assembly portion 11 merges via the graduation 16.1 into the retention portion 16. This portion is orientated so as to be offset parallel with the assembly portion 11. The blocking element 20 is pivotably connected by means of the axle 26 to the retention webs 17 of the base carrier 10. To this end, the axle 26, as described with reference to FIG. 3, is inserted through the axial holes 17.1 of the retention webs 17 which are arranged opposite each other and the axle receiving members 22.1 which are formed in the articulated portions 22 of the blocking element 20. The springs 25 are each fitted with the winding region 25.1 thereof on the axle 26. In this instance, the legs 25.2 of the springs 25 abut the spring abutment face 21.2 of the blocking element 20. The curved resilient members 25.3 abut the retention attachment 16. They are guided laterally through the spring guides 18 formed on the retention attachment 16. The springs 25 are pretensioned. A torque which is directed counter to an actuation direction 9.2 indicated by an arrow is thereby transmitted to the blocking element 20. The blocking element 20 is thereby adjusted about the rotation axis thereof formed by the axle 26 into the closure position shown and retained. In this closure position, the retention portions 23 abut the retention attachment 16. As a result of the graduation 16.1, it is possible for the rotation axis formed by the axle 26 to be arranged in extension of the sliding guide 15.3. As a result of a pressure at the actuation side 21.1, the blocking element 20 can be adjusted counter to the resilient force in accordance with the actuation direction 9.2 from the closure position shown into an open position.

Figure 6:
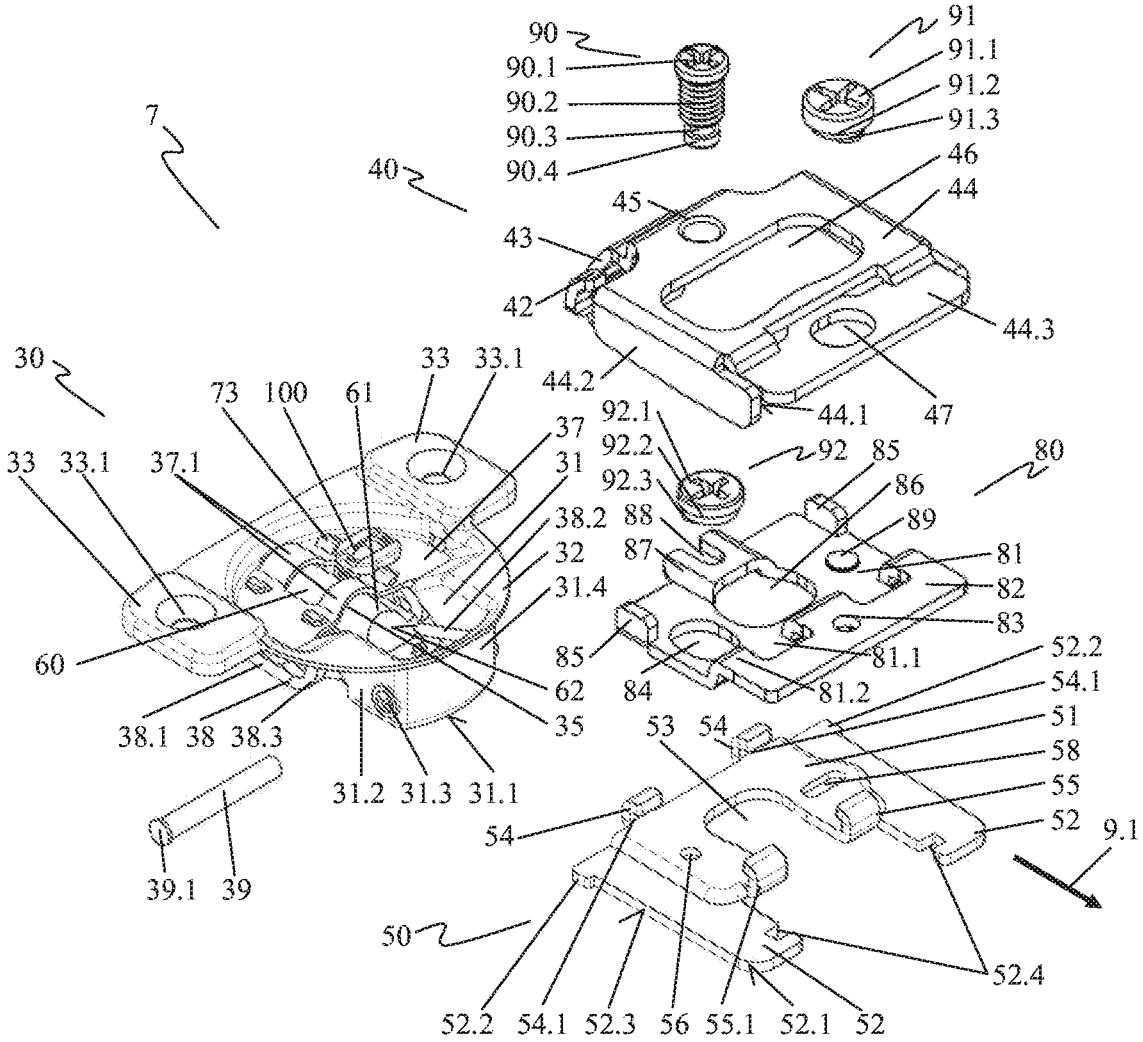

FIG. 6 is an exploded view of a hinge member 7 with a hinge cup 30 for securing the furniture hinge 1 to a furniture door 5, flap or the like. A hinge arm 40 and in this instance an intermediate portion 80 and a connection element 50 are further associated with the hinge member 7.

As shown in FIG. 1, the hinge cup 30 can be introduced into a hole in the furniture door 5 and using screws which are guided through lateral flanges 33 formed laterally on the hinge cup 30 can be screwed to the furniture door 5, flap or the like. To this end, the lateral flanges 33 are penetrated by assembly holes 33.1. A centering region 31 forms, starting from an outer abutment face 32, a recess which merges into an assembly region 34 (see FIG. 9) of the hinge cup 30 which is also constructed as a recess. In the direction toward the furniture door 5, the hinge cup 30 is terminated in the assembly region 34 by a cover 37. Locking recesses in the form of apertures are introduced in the cover 37. Locking elements 73 are engaged in the locking recesses. The locking elements 73 are part of a housing 70 shown in FIG. 11 for receiving a linear damper 60. The linear damper 60 is consequently arranged outside the hinge cup 30 below the cover 37 of the assembly region 34. In order to provide sufficient space for receiving the linear damper 60, the cover 37 has a formation 37.1 along which the linear damper 60 is arranged.

A portion of the linear damper 60 is introduced through an opening 35 in the centering region 31. In the embodiment shown, a movably supported cylinder 61 of the linear damper 100 is introduced into the centering region 31. The cylinder 61 has at the end side an inclination 62. A locking element 100 is inserted in a recess of the cover 37. Using the locking element 100, the linear damper 60 can be blocked in a retracted position so that the inclination 62 is not guided into the centering region 31.

A second spring 38 is also arranged outside the hinge cup 30. It is guided with the free ends 38.2 thereof through the opening 35 into the centering region 31. The second spring 38 which is constructed as a leg spring has a winding 38.3 and a second curved resilient member 38.1.

The centering region 31 is formed by cup side walls 31.2, a rounded portion 31.4 and a cup base 31.1. In the opposing cup side walls 31.2, articulated receiving members 31.3 in the form of holes are introduced. An articulated pin 39 with end-side stop portions 39.1 is associated with the articulated receiving members 31.3. In this instance, a stop portion 39.1 is formed on the articulated pin 39 only when the hinge member 7 is assembled.

The hinge arm 40 has an articulated lever 43. At the end side and facing the hinge cup 30, a pin receiving member 41 is formed on the articulated lever 43, as shown in greater detail in FIG. 9. The pin receiving member 41 is constructed as a cylindrically bent end region of the articulated lever 43. In the region of the pin receiving member 41, two guiding curves 42 are arranged on the articulated lever 43 in a laterally opposed manner.

The articulated lever 43 is integrally connected to a securing portion 44 of the hinge arm 40. It is also conceivable for the articulated lever 43 and the securing portion 44 to be constructed separately and to be connected to each other, for example, using securing means. Preferably, the securing portion 44 is constructed as a punched component. It has side regions 44.2 which are angled laterally in the direction toward the connection element 50. These regions form guiding faces 41.1 which are orientated in the direction of the longitudinal extent of the hinge arm 40. A threaded receiving member 45 and a recess 46 are introduced into the securing portion 44. Via a graduation, an attachment piece 44.3 is formed on the securing portion 44. The plane of the attachment piece 44.3 is in this instance arranged so as to be offset in the direction toward the intermediate portion 80 with respect to the plane of the securing portion 44. The attachment piece 44.3 is penetrated by an X-cam guide 47 in the form of an elongate hole.

The intermediate portion 80 is arranged between the hinge arm 40 and the connection element 50 and orientated for assembly with the hinge arm 40 and the connection element 50. The intermediate portion 80 has an abutment portion 81 which is constructed in a planar manner and on which an attachment 82 which is also constructed in a planar manner is formed. The plane of the attachment 82 is in this instance offset with respect to the plane of the abutment portion 8.1 in the direction toward the hinge arm 40. The attachment 82 is arranged opposite the attachment piece 44.3 of the hinge arm 40. The attachment 82 is in this instance connected to the abutment portion 81 by means of three webs 81.2 which are orientated in the direction toward the hinge arm 40. Between the webs 81.2, the abutment portion 81 has in each case an extension in the form of guiding flaps 81.1. In the attachment 82, an X-cam bearing 83 in the form of a hole is introduced in alignment with the X-cam guide 47. Opposite the recess 46 of the hinge arm 40, a Y-cam guide 84 in the form of an elongate hole and a through-opening 86 are formed in the abutment portion 81. Opposite the Y-cam guide 84, a Y-guiding cam 89 is fitted to the abutment portion 81. The Y-guiding cam 89 is guided through the abutment portion 81 and rises above the face of the abutment portion 81 in the direction toward the connection element 50. Side flaps are fitted laterally to the abutment portion 81. The side flaps 85 are angled with respect to the abutment portion 81 and orientated in the direction toward the hinge arm 40. Opposite the stop 82, a securing web 87 is formed on the abutment portion 81. The securing web 87 rises in the direction toward the hinge arm 40 above the face of the abutment portion 81. The upper face thereof is arranged at the height of the attachment 82 of the intermediate portion 80. In the surface of the securing web 87, starting from the outer edge thereof, an adjustment screw receiving member 88 in the form of a slot is formed. The adjustment screw receiving member 88 is arranged opposite the thread receiving member 45 of the hinge arm 40.

The connection element 50 has a base member 51 which is constructed in a planar manner. In the assembly direction 9.1, two external retention flaps 55 are formed on the base member 51. The external retention flaps 55 are bent in such a manner from the plane of the base member 51 in the direction toward the hinge arm 40 that they each engage around an external retention groove 55.1 which is open counter to the assembly direction 9.1. Opposite the external retention flaps 55, internal retention flaps 54 are formed on the edge of the base member 51. The internal retention flaps 54 are constructed in a mirror-symmetrical manner with respect to the external retention flaps 55 so that in each case an internal retention groove 54.1 which is surrounded by the internal retention flaps 54 is orientated in the direction toward the opposing external retention groove 55.1 of the external retention flaps 55. As a result of the retention flaps 54, 55, a linear guide which is directed transversely relative to the assembly direction 9.1 is consequently formed. The intermediate portion 80 can be introduced with the edge thereof orientated counter to the assembly direction 9.1 into the internal retention grooves 54.1 and with the edges of the guiding flaps 81.1 thereof orientated in the assembly direction 9.1 into the external retention grooves 55.1 The intermediate portion 80 can thus be displaced transversely relative to the assembly direction 9.1 and in the plane of the abutment portion 81, whilst it is retained in the remaining directions by the retention flaps 54, 55 or the base member 51 of the connection element 50. In this instance, the Y-guiding cam 89 is guided in a Y-guiding elongate hole 58 of the connection element 50.

Laterally and opposite each other, a guiding portion 52 is formed on the base member 51 of the connection element 50. The guiding portions 52 are constructed in a planar manner. They are orientated in the longitudinal extent thereof in the assembly direction 9.1. The side edges of the guiding portions 52 arranged transversely relative to the assembly direction 9.1 form guide edges 52.3. In the direction toward the front end, in each case in extension of the guide edges 52.3 an outwardly facing rounded introduction portion 52.1 is formed on the guiding portions 52. In the region of the, with respect to the assembly direction 9.1, front end of the guiding portions 52, they are in each case penetrated by a locking recess 52.4. The locking recesses 52.4 are introduced in the guiding portions 52 in a groove-like manner and facing each other. Counter to the movement direction 9.1 and opposite the rounded introduction portions 52.1, an abutment portion 52.2 is formed in each case on the guiding portions 52. These delimit the guide edges 52.3

An aperture 53 is introduced in the base member 51. The aperture 53 is arranged opposite the through-opening 86 of the intermediate portion 80 and consequently the recess 46 of the hinge arm 40. At the side of the aperture 53 of the base member 51, a Y-cam bearing 56 in the form of a hole is introduced into the base member 51. The Y-cam bearing 56 is arranged in alignment with the Y-cam guide 84 of the intermediate portion 80. At the opposite side of the aperture 53, the base member 51 is penetrated by the Y-elongate guide hole 58. The Y-elongate guide hole 58 is arranged opposite the Y-guiding cam 89 of the intermediate portion 80.

The hinge member 7 is further associated with an adjustment screw 90 having an adjustment screw tool receiving member 90.1, a thread 90.2, a groove 90.3 and a closure 90.4. The adjustment screw 90 is constructed in such a manner that it can be screwed with the thread 90.2 thereof into the thread receiving member 45 of the hinge arm 40. The groove 90.3 then engages in the adjustment screw receiving member 88 of the intermediate portion 80. Axially, the mounted adjustment screw 90 is retained by means of the closure 90.4 which is increased in diameter with respect to the groove on the securing web 87 of the intermediate portion 80.

An X-cam 91 is associated with the hinge member 7. The X-cam 91 has an X-tool receiving member 91.1, an X-guiding region 91.2 and an X-eccentric cam 91.3. The X-eccentric cam 91.3 is arranged outside the center axis of the X-guiding region 91.2. The X-cam 91 is orientated with respect to the X-cam guide 47 of the hinge arm 40 and the X-cam bearing 83 of the intermediate portion 80. In the assembled state, the X-eccentric cam 91.3 engages in the X-cam bearing 83. The X-guiding region 91.2 is guided in the X-cam guide 47 of the hinge arm 40.

There is further associated with the hinge member 7 a Y-cam 92 which in terms of its construction corresponds to the X-cam 91. It consequently has a Y-tool receiving member 92.1, a Y-guiding region 92.2 and a Y-eccentric cam 92.3. The Y-eccentric cam 92.3 is arranged outside the center axis of the Y-guiding region 92.2. The Y-cam 92 is orientated with respect to the Y-cam guide 84 of the intermediate portion 80 and the Y-cam bearing 56 of the connection element 50. In the assembled state, the Y-eccentric cam 92.3 engages in the Y-cam bearing 56. The Y-guiding region 92.2 is guided in the Y-cam guide 84 of the intermediate portion 80.

Figure 7:
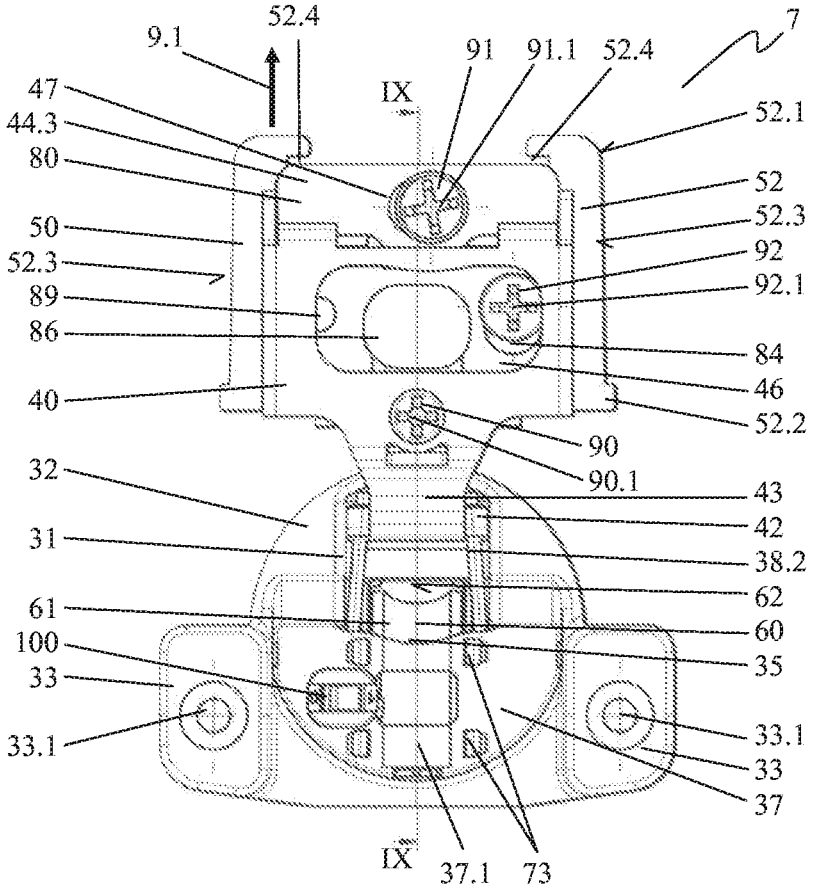
FIG. 7 is a plan view of the assembled hinge member shown in FIG. 6.
Figure 8:
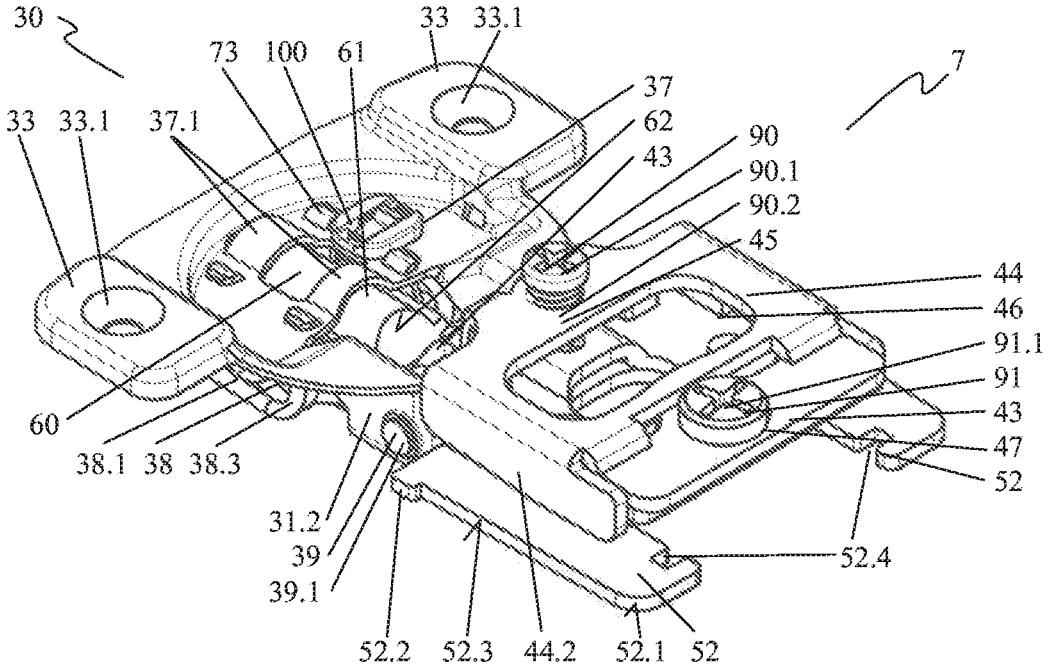
FIG. 8 is a perspective view of the hinge member shown in FIG. 7.
Figure 9:
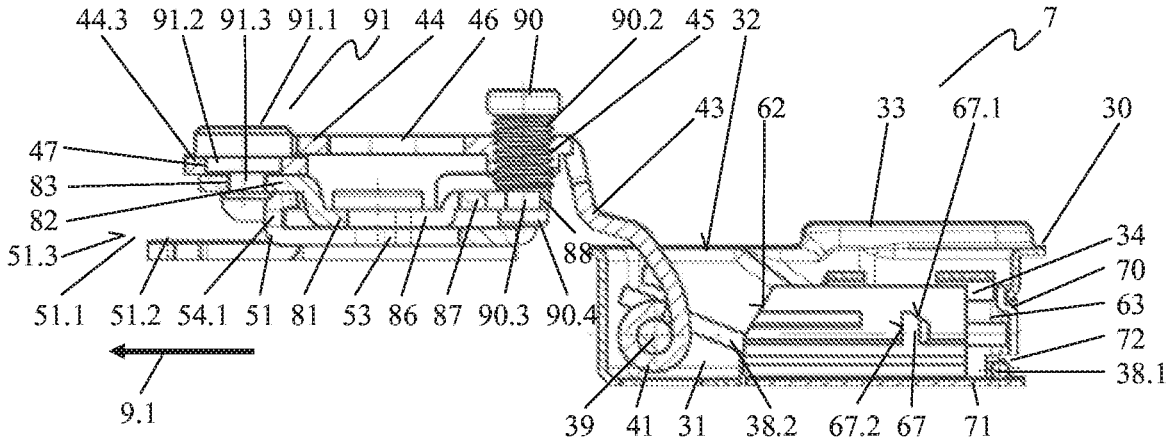
FIG. 9 is a lateral sectioned illustration of the hinge member shown in FIG. 7.

FIG. 7 is a plan view of the assembled hinge member 7 shown in FIG. 6. In FIG. 8, the hinge member 7 shown in FIG. 7 is shown as a perspective view, whilst FIG. 9 shows the hinge member 7 shown in FIG. 7 as a lateral sectioned illustration. The section extends in this instance along a line of section indicated IX in FIG. 7.

As can be seen in particular in FIG. 9, the articulated lever 43 is guided into the centering region 31 of the hinge cup 30 and secured in an articulated manner at that location. To this end, the articulated pin 39 shown in FIG. 6 is guided through the articulated receiving members 31.3 of the cup side walls 31.2 of the centering region 31 and the pin receiving member 41 of the articulated lever 43 and axially secured by end-side stop portions 39.1, as can be seen in particular in FIG. 8. The free ends 38.2 of the second spring 38 rest on the guiding curves 42 on the articulated lever 43 and transmit a resilient force to them. The guiding curves 42 are in this instance configured in such a manner that the second spring 38 from a specific opening angle of the furniture hinge 1 supports an opening movement and from a specific closure angle of the furniture hinge 1 supports a closure movement of the furniture hinge 1 and consequently the connected furniture door 5, flap or the like. As can be seen clearly in FIG. 9, the linear damper 60 is introduced with the inclination 62 of the cylinder 61 thereof into the centering region 31 and consequently into the adjustment path of the articulated lever 43. Opposite, the linear damper 60 is supported with a piston 63 on the housing 70. When the furniture hinge 1 is closed, the articulated lever 43 abuts the inclination 62 of the linear damper 60 and presses it together. The closure movement of the furniture hinge 1 is thereby damped in the last movement portion thereof. The movement of the linear damper 60 can be blocked by means of the locking element 100 shown in FIGS. 7 and 8 in the retracted position thereof. A non-damped furniture hinge 1 is thereby obtained.

The securing portion 44 of the hinge arm 40 is connected to the intermediate portion 80, as shown in greater detail in FIG. 9. The intermediate portion 80 is in turn connected to the connection element 50. In this instance, the intermediate portion 80 is supported so as to be able to be linearly adjusted transversely to the assembly direction 9.1 on the connection element 50, as described in relation to FIG. 6.

As can be seen clearly in FIG. 9, the adjustment screw 90 is screwed with the thread 90.2 thereof into the thread receiving member 45 of the hinge arm 40. It is supported with the groove 90.3 thereof in the adjustment screw receiving member 88. As a result of the closure 90.4 which is expanded in terms of its diameter with respect to the groove 90.3, the intermediate portion 80 is axially retained by the adjustment screw 90. The X-cam 91 is guided with the X-guiding region 91.2 thereof laterally in the X-cam guide 47 of the hinge arm 40 and inserted with the eccentrically arranged X-eccentric cam 91.3 in the X-cam bearing 83 of the intermediate portion 80. The Y-cam 92 is accordingly guided (and not illustrated in section) with the Y-guiding region 92.2 thereof laterally in the Y-cam guide 84 of the intermediate portion 80 and inserted with the Y-eccentric cam 92.3 thereof into the Y-cam bearing 56 of the connection element 50 as shown in FIG. 6. In this instance, the Y-tool receiving member 92.1 is accessible via the recess 46 in the securing portion 44 of the hinge arm 40, as can be seen in particular in FIG. 7.

The adjustment screw 90 and the two cams 91, 92 serve to orientate the assembled furniture door 5 on the furniture carcass 3. In this instance, by means of the adjustment screw 90, the spacing between the securing portion 44 of the hinge arm 40 and the intermediate portion 80 can be changed and consequently the furniture door 5 can be adjusted along the z axis 8.3, as shown in FIG. 1. The X-cam 91 enables the adjustment of the assembled furniture door 5 along the x axis 8.1 shown in FIG. 1. In this instance, by rotating the X-cam 91, the hinge arm 40 is displaced relative to the intermediate portion 80 in the x direction 8.1. The intermediate portion 80 is to this end laterally guided by the guiding faces 44.1 of the side regions 44.2 of the securing portion 44 of the hinge arm 40 which the side flaps 85 and the attachment 82 of the intermediate portion 80 abut (see in this regard FIG. 6). The Y-cam 92 enables the orientation of the furniture door 5 along the y axis 8.2 shown in FIG. 1. As a result of a rotation of the Y-cam 92, the intermediate portion 80 and consequently the hinge arm 40 which is connected to the intermediate portion so as to be blocked in the y direction is adjusted in a linear manner along the y axis 8.2 with respect to the connection element 50. The intermediate portion moves in this instance in a manner guided by the retention grooves 54.1, 55.1 formed by the retention flaps 54, 55, as also shown in FIG. 6. In this instance, additional guiding by the Y-guiding cam 89 of the intermediate portion 80 is achieved, which cam 89 is guided in a linear manner in the Y-guiding elongate hole 58 of the connection element 50.

As can be seen in FIGS. 7 and 9, in the assembly direction 9.1 the guide portions 52 of the base member 51 of the connection element 50 with the locking recesses 52.4 thereof form the foremost region of the hinge member 7.

As can be seen in particular in the view selected in FIG. 8, the second spring 38 is arranged outside the hinge cup 30. As shown in FIG. 7, it is guided with the free ends 38.2 thereof through the opening 35 into the centering region 31 of the hinge cup 30 and at that location to the guiding curves 42 of the hinge arm 40. The linear damper 60 is also arranged with the housing 70 thereof below the assembly region 34 of the hinge cup 30 and guided through the opening 35 into the centering region 31. In the sectioned illustration in FIG. 9, the support of the second spring 38 on the housing 70 is shown. The housing 70 forms in the direction toward the housing base 71 thereof at the side facing away from the hinge arm 40 a spring receiving member 72. The second curved resilient member 38.1 of the second spring 38 is retained in the spring retention member 72.

As shown in particular in FIG. 9, the centering region 31 forms a recess starting from the outer abutment face 32. The assembly region 34 also forms such a recess. In this instance, the cup depth in the assembly region 34 is smaller than in the centering region 41. The assembly region 34 is terminated with a cover 37. The linear damper 60 is fitted from the outer side to the cover 37 of the assembly region 34. To this end, the linear damper 60 is supported in the housing 70. The housing 70 is secured by means of the locking elements 73 shown in FIG. 6 to the cover 37 of the assembly region 34. The housing base 71 is preferably arranged in the same plane as the cup base 31.1 of the centering region 31.

A blocking attachment 67 is fitted on the cylinder 61 of the linear damper 60. In this instance, the blocking attachment 67 is formed on the cylinder 61. Facing away from the housing base 71, the locking attachment 67 has an inclined start-up member 67.1. The attachment inclination 67.1 is in this instance inclined in the direction of the movement of the cylinder 61 when the linear damper 60 is pushed together. In a state directed in the movement direction of the cylinder 61 when the linear damper 60 is pushed apart, the blocking attachment 67 forms a blocking counter-face 67.2.

Figure 10:
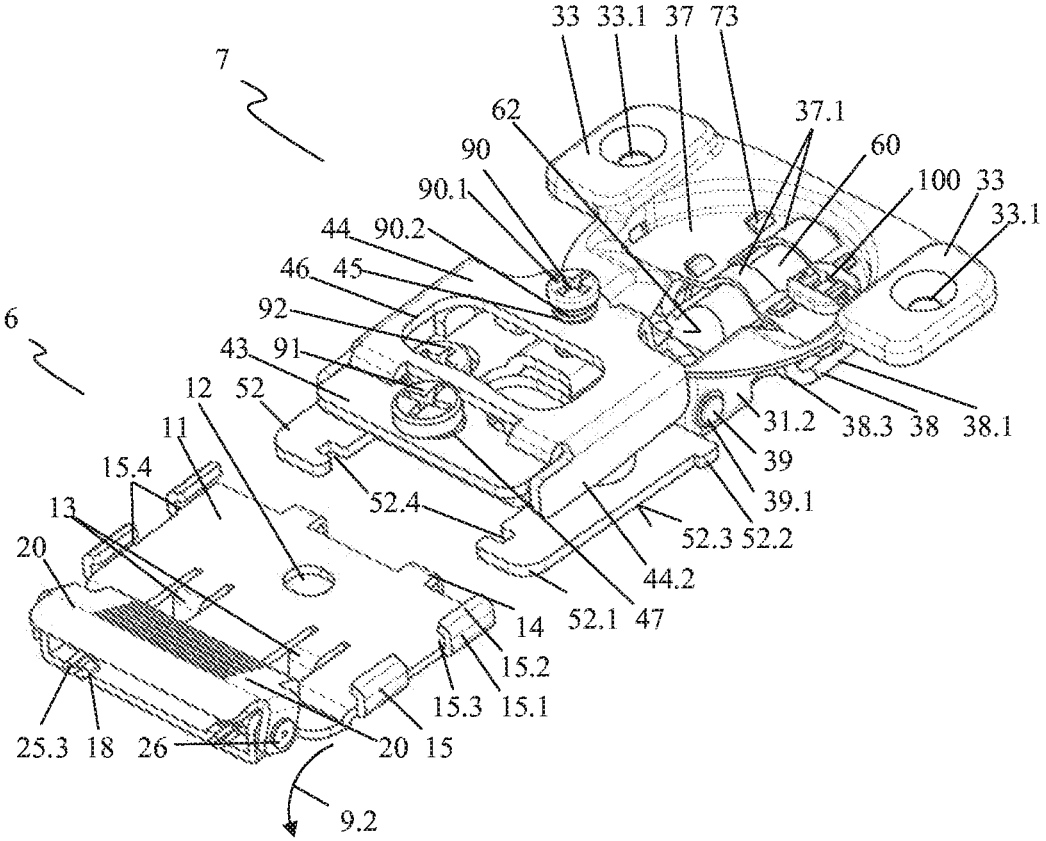
FIG. 10 is a perspective view of the hinge member and the assembly member in a position orientated with respect to each other.

FIG. 10 is a perspective view of the hinge member 7 and the assembly member 6 in a position orientated with respect to each other. In this instance, in a modification of the illustrations in FIGS. 2 to 5, the actuation portion 21 of the blocking element 20 is extended over the legs 25.2 of the springs 25 and angled so that the springs 25 are covered in the direction toward a user. The hinge member 7 is folded open and in this position retained by the second spring 38. The guiding portions 52 of the connection element 50 are orientated with the locking recesses 52.4 thereof in the direction toward the blocking element 20 of the assembly member 6. They protrude laterally over the fixing portion 44 of the hinge arm 40. The hinge member 7 can thus be pushed with the guiding portions 52 thereof in the assembly direction 9.1 into the sliding guide 15.3 of the assembly member 6. The sliding guide 15.3 is in this instance formed by the guiding grooves 15.4, as formed by the lateral guides 15 which are arranged laterally on the assembly portion 11 of the base carrier 10 of the assembly member 6. When the connection element 50 is inserted into the sliding guide 15.3, the guide edges 52.3 of the guiding portions 52 slide along the inner faces of the lateral portions 15.1 of the lateral guides 15. The hinge member 7 can consequently be adjusted when the guide portions 52 are inserted into the sliding guide 15.3 only in or counter to the assembly direction 9.1. The rounded introduction members 52.1 facilitate the introduction of the guide portions 52 into the guiding grooves 15.4

In a first assembly step, the connection element 50 is pushed into the sliding guide 15.3 until the guiding portions 52 abut with the front edges thereof the retention portions 23 of the blocking element 20 shown in FIG. 5. The hinge member 7 is now retained transversely relative to the assembly direction 9.1 on the assembly member 6. To push the connection element 50 further into the sliding guide 15.3, the blocking element 20 is adjusted from the closure position thereof shown in FIG. 10 in the actuation direction 9.2 into an open position. In this instance, the blocking element 20 pivots counter to the resilient force introduced by the two springs 25 about the rotation axis formed by the axle 26. When the connection element 50 is further displaced in an assembly direction 9.1, the locking recesses 52.4 reach the region of the retention portions 23 shown in FIG. 5. As a result of the springs 25, the blocking element 20 is now adjusted into its closure position again, whereby the retention portions 23 engage in the locking recesses 52.4. The hinge member 7 is thereby also blocked in or counter to the assembly direction 9.1. When the assembly position in which the locking recess 52.4 is arranged opposite the retention portion 23 of the blocking element 20 is reached, the stop portions 52.2 which are laterally fitted to the guiding portions 52 abut the front lateral guides 15.3. In the assembly position, a precise orientation of the hinge member 7 with respect to the assembly member 6 is thereby achieved.

Figure 11:
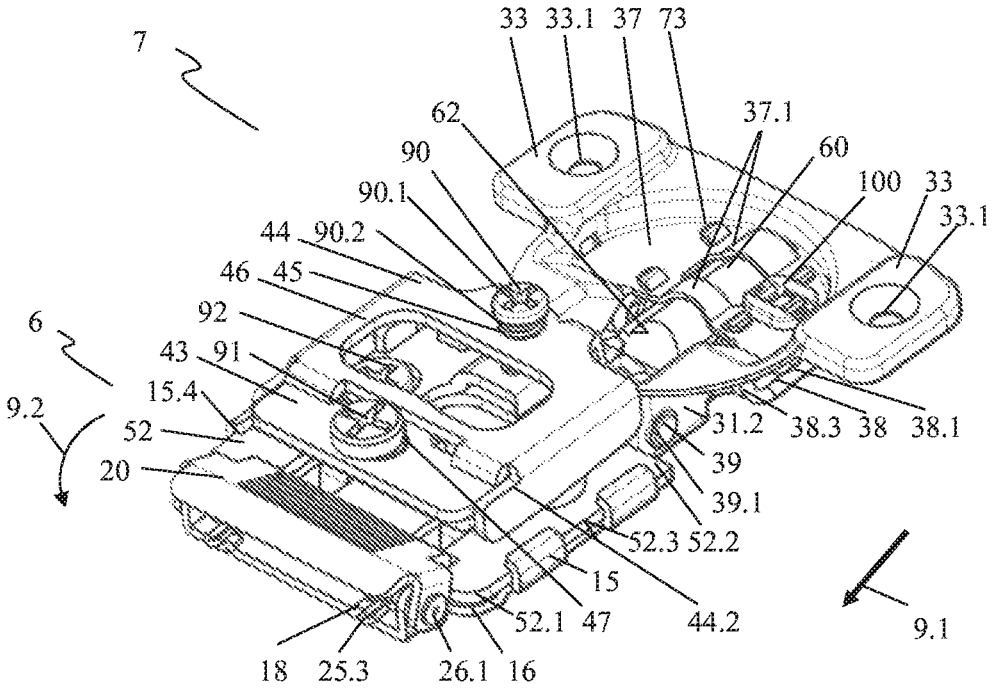
FIG. 11 is a perspective view of the assembled furniture hinge.
Figure 12:
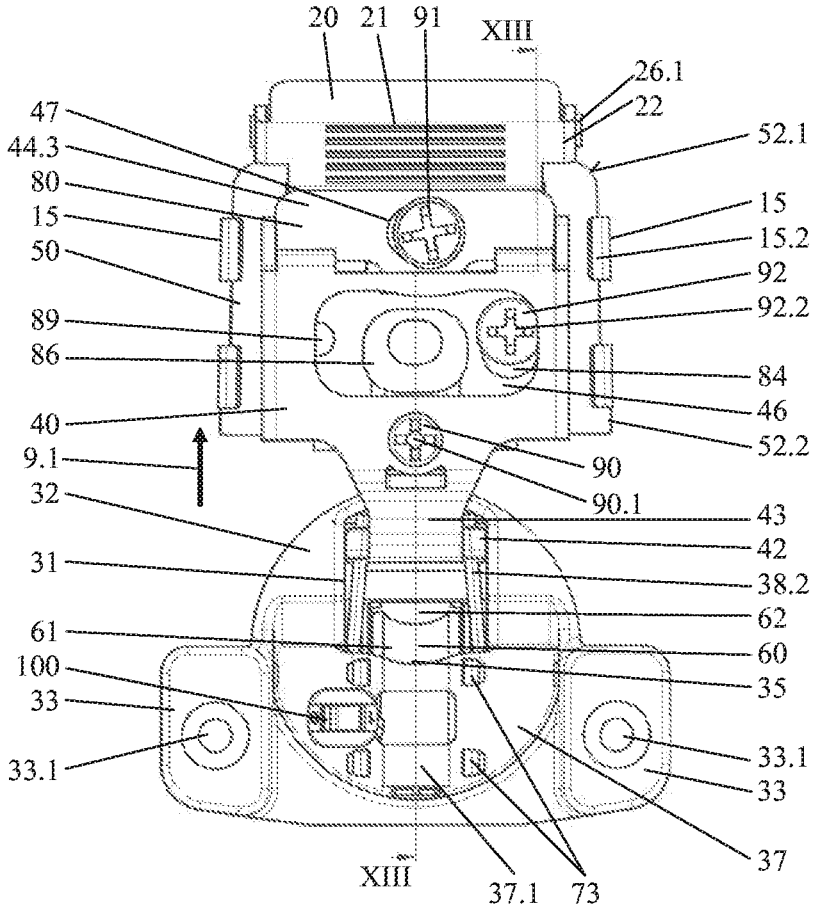
FIG. 12 is a plan view of the furniture hinge shown in FIG. 11.
Figure 13:
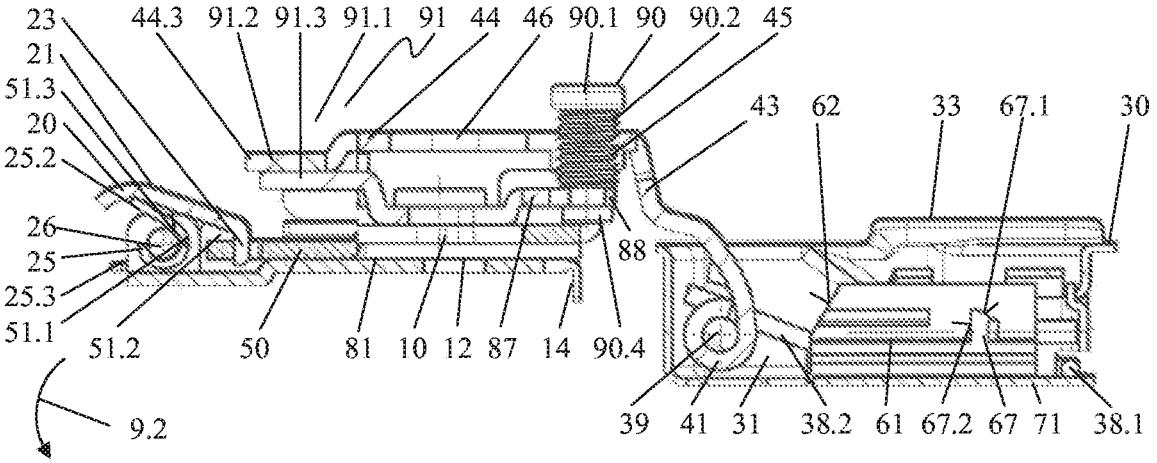
FIG. 13 is a lateral sectioned illustration of the furniture hinge shown in FIG. 11.

FIG. 11 is a perspective view of the assembled furniture hinge 1. FIG. 12 is a plan view of the furniture hinge 1 shown in FIG. 11. FIG. 13 is a lateral sectioned illustration of the furniture hinge 1 shown in FIG. 11. The section path is in this instance marked in FIG. 12 and designated XIII.

The connection element 50 is inserted as a component connected to the hinge arm 40 as far as the assembly position thereof in the sliding guide 15.3 of the assembly member 6. Transversely relative to the assembly direction 9.1, the connection element 50 is retained by the lateral guides 15. In the assembly direction 9.1, the stop portions 52.2 abut the lateral guides 15 which face away from the blocking element 20. Counter to the assembly direction 9.1, the connection element 50 is blocked by the engagement of the retention portions 23 of the blocking element 20 in the locking recesses 52.4 of the guide portions 52 of the connection element 50, as can be seen in particular in the sectioned illustration in FIG. 13. The blocking element 20 is retained by the two springs 25 in the closure position thereof. Consequently, the hinge member 7 is secured to the assembly member 6.

In order to release the hinge member 7 from the assembly member 6, the blocking element 20 can be adjusted into the open position thereof by means of a pressure on the actuation side 21.1 of the actuation portion 21 thereof counter to the resilient force produced by the springs 25. The blocking element 20 is in this instance pivoted in accordance with the actuation direction 9.2 about the axle 26. The retention portions 23 of the blocking element 20 are thus moved out of engagement with the locking recesses 52.4 of the connection element 50. The connection element 50 can now be pulled counter to the assembly direction 9.1 from the sliding guide 15.3.

Figure 14:
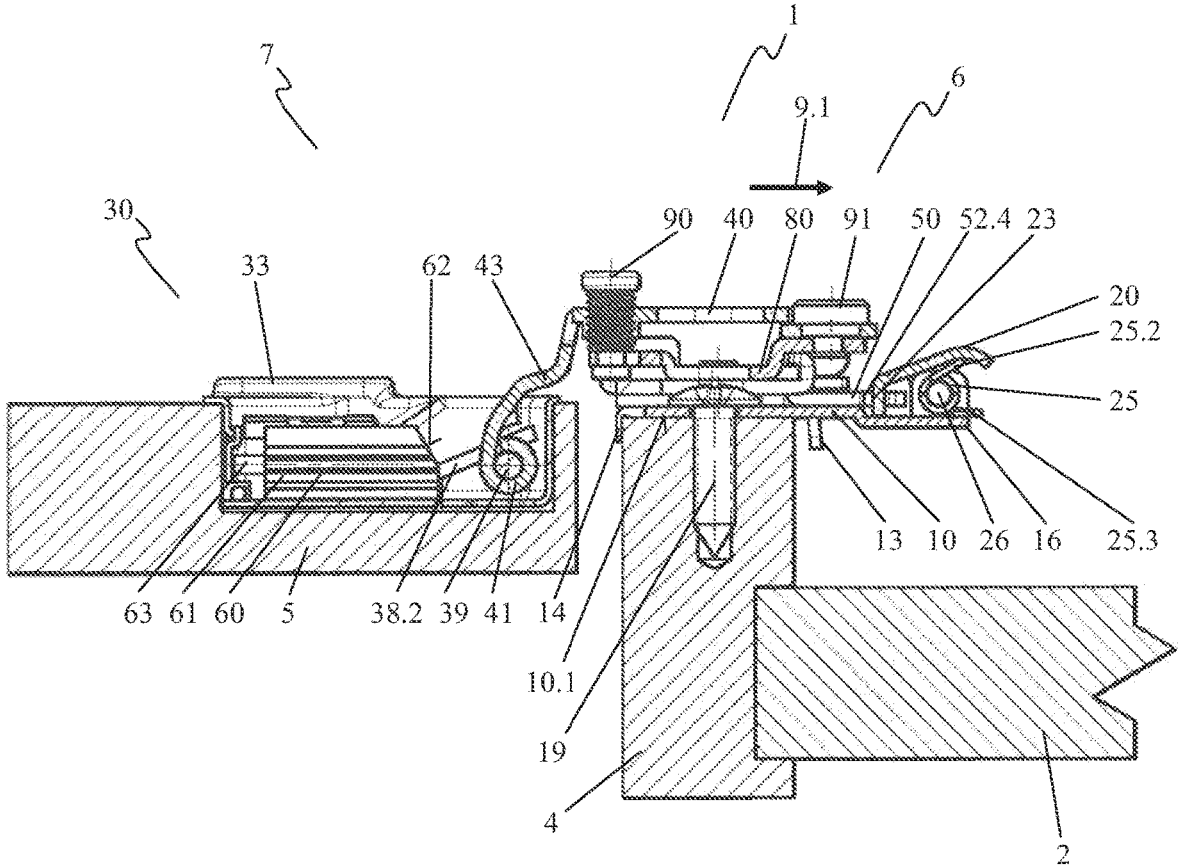
FIG. 14 is a side view of the furniture hinge mounted on an item of furniture.

FIG. 14 shows in a sectioned view the furniture hinge 1 which is assembled on the item of furniture 2. The hinge cup 40 is secured in a hole of the furniture door 5 and screwed laterally at the side flanges 33 to the furniture door 5. The assembly member 6 is secured to the frame 4 of the item of furniture 2. To this end, the assembly member 6 abuts with the assembly face 10.1 thereof the frame 4. The outer stop 14 abuts the edge of the frame 4. The position of the assembly member 6 is thereby secured with respect to the frame 4. The assembly member 6 is secured to the frame 4 by means of a screw connection. To this end, a screw 19 is guided through the recess 12 of the base carrier 10.

For assembly of the furniture door 5, the assembly member 6 and the hinge member 7 are in a separate state. Both are preassembled. Firstly, the assembly member 6 is orientated with the outer stop 14 on the frame 4. Subsequently, the assembly member 6 is screwed to the frame 4. The hinge cup 30 is introduced into the hole of the furniture door 5, orientated and screwed to the furniture door 5. When a plurality of furniture hinges 1 are provided, these are accordingly assembled. The furniture hinge(s) 1 is/are folded into the open position thereof. Subsequently, the furniture door 5 is retained at the opening of the furniture carcass 2 and orientated in such a manner that the guiding portions 52 of the respective connection element 50 are orientated with respect to the sliding guide 15.2 arranged on the assembly member 6. The furniture door 5 is now pushed in the direction toward the furniture carcass 2. In this instance, the guiding portions 52 are introduced into the sliding guide 15.3. As a result of the rounded introduction portions 52.1, the guiding portions 52 can also be introduced when a plurality of furniture hinges 1 are provided on the furniture door 5 simply and simultaneously into the sliding guides 15.2.

Firstly, the guiding portions 52 are pushed into the sliding guide 15.3 until they abut the retention portions 23 of the blocking element 20. The connection element 50 is now retained transversely relative to the assembly direction 9.1 in the sliding guide 15.3. The sliding guide 15.3 is orientated in such a manner that the connection element 50 does not slide out of the sliding guide 15.3 as a result of the weight. A fitter can consequently release the furniture door 5 with the connection element 50 partially inserted without it falling down. In another operating step, the connection element 50 is inserted further in the assembly direction 9.1 into the sliding guide 15.3. This may, for example, be carried out by means of a corresponding pressure on the furniture door 5. In this instance, the blocking element 20 is adjusted by means of a corresponding pressure on the actuation portion into the open position thereof. The connection element 50 can now be inserted into the sliding guide 15.3 until the final assembly position is reached. In this assembly position, the stop portions 52.2 of the guiding portions 52 abut the front lateral guides 15 of the base carrier 10. The locking recesses 52.4 on the guiding portions 52 of the connection element 50 are arranged in the region of the retention portion 23 of the blocking element 20. The blocking element 20 is therefore rotated by the springs 25 into the closure position thereof shown in FIG. 14 and the retention portions 23 are moved into engagement with the locking recesses 52.4 of the connection element 50. A movement of the hinge member 7 in or counter to the assembly direction 9.1 is thereby blocked. For disassembly, the blocking element 20 is adjusted manually into the open position thereof. The connection element 50 can now be pulled out of the assembly position thereof counter to the assembly direction 9.1. The connection element 50 is in this instance further retained by the sliding guide 15.3 transversely relative to the assembly direction 9.1. A fitter can consequently release one after the other a plurality of furniture hinges 1 provided on the furniture door 5 without at the same time having to retain the weight of the furniture door 5. If all the connection elements 50 of the furniture hinges 1 provided are pulled out of their assembly position, the furniture door 5 can be removed from the furniture carcass 3.

Figure 15:
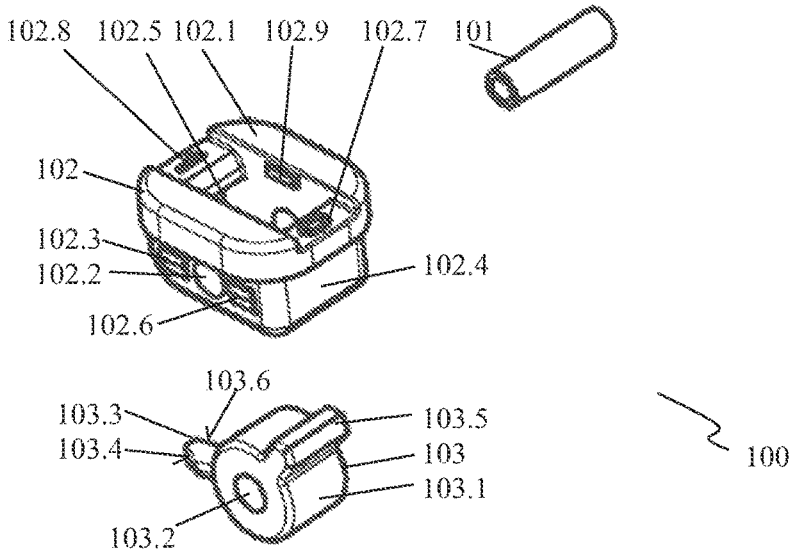
FIG. 15 is a perspective exploded view of a locking element.

FIG. 15 is a perspective exploded view of the locking element 100. A bearing pin 101, a locking element housing 102 and a locking element insert 103 are associated with the locking element 100.

The locking element housing 102 has locking element housing side walls 102.3 which are arranged opposite each other. The locking element housing side walls 102.3 are connected to each other at the end side by means of a locking element housing outer wall 102.4 and opposite each other by means of a locking element housing inner wall 102.5 which is concealed in the selected view to the greatest possible extent. On the locking element housing side walls 102.3, the locking element housing outer wall 102.4 and the locking element housing inner wall 102.5 there is placed a peripheral abutment flange 102.1 which protrudes outward over the respective walls. Opposite the abutment flange 102.1, the locking element housing 102 is terminated by a locking element housing base which is arranged so as to be concealed. Toward the locking element housing outer wall, a locking switching position 102. 7 is indicated in this instance by a 0 on the abutment flange 102.1. Opposite and orientated in the direction toward the locking element housing inner wall 102.5, a damping switching position 102.8 is marked on the abutment flange 102.1, in this instance by a 1. Locking attachments 102.6 are fitted toward the outer side on the locking element housing side walls 102.3. Toward the inner side, a locking device 102.9 which is in this instance constructed in the manner of a web is formed on the locking element housing side walls 102.3. The locking element housing side walls 102.3 are further penetrated in each case by bearing pin guides 102.2 which are arranged in alignment with each other.

The locking element insert 103 is formed by a cylindrical rotary member 103.1 on the outer periphery of which a handle 103.5 and a locking bolt 103.3 which are arranged angularly offset with respect to each other are formed. The rotary member 103.1 is penetrated along the longitudinal center axis thereof by a bearing pin receiving member 103.2. The locking bolt 103.3 has a blocking face 103.6. The surface normal of the blocking face 103.6 is orientated in the direction of the longitudinal extent of the bearing pin receiving member 103.2. Opposite the blocking face 103.6, the locking bolt 103.3 is constructed in a chamfered manner at the end side by means of an inclined start-up member 103.4. The length of the cylindrical rotary member 103.1 is selected in such a manner that the rotary member 103.1 can be arranged with little play between the two locking element housing side walls 102.3 and the bearing pin receiving member 103.2 can be orientated in alignment with the bearing pin guides 102.2 of the locking element housing 102. The cylindrical bearing pin 101 can thus be inserted through the bearing pin guides 102.2 and the bearing pin receiving member 103.2. The locking element insert 103 is thereby rotatably supported in the locking element housing 102. With the locking element 100 mounted, the handle 103.5 protrudes in the region of the abutment flange 102.1 from the locking element housing 102. The locking bolt 103.3 is guided through an opening which is arranged so as to be concealed in the locking element housing inner wall 102.5 out of the locking element housing 102. Using the handle 103.5, the locking element insert 103 can be rotated about the rotation axis formed by the bearing pin 101. In this instance, the locking bolt 103.3 also pivots about this rotation axis. The locking element insert 103 can in this instance be adjusted in two switching positions, that is to say, the locking switching position 102.7 and the damping switching position 102.8. These are reached when the handle 103.5 in the region of the associated marking (0 or 1) abuts the abutment flange 102.1. In the two switching positions, the locking element insert 103 is retained by the locking device 102.9103.9. Inadvertent adjustment of the locking element 100, for example, by a user of the piece of furniture, can thereby be prevented.

The handle 103.5 is arranged at the side of the rotation axis on a peripheral path about the rotation axis. A lever is thereby formed and also with a small-sized handle 103.5 enables simple tool-free actuation of the locking element 100. As a result of the lateral arrangement of the handle 103.5 with respect to the rotation axis, no actuation device which is arranged in an axial direction of the locking element 100 has to be provided. The locking element 100 can thereby be arranged to a large extent outside the hinge cup 30 and only the handle 103.5 has to be guided in the inner space of the hinge cup 30, as shown in greater detail in FIG. 17.

Figure 16:
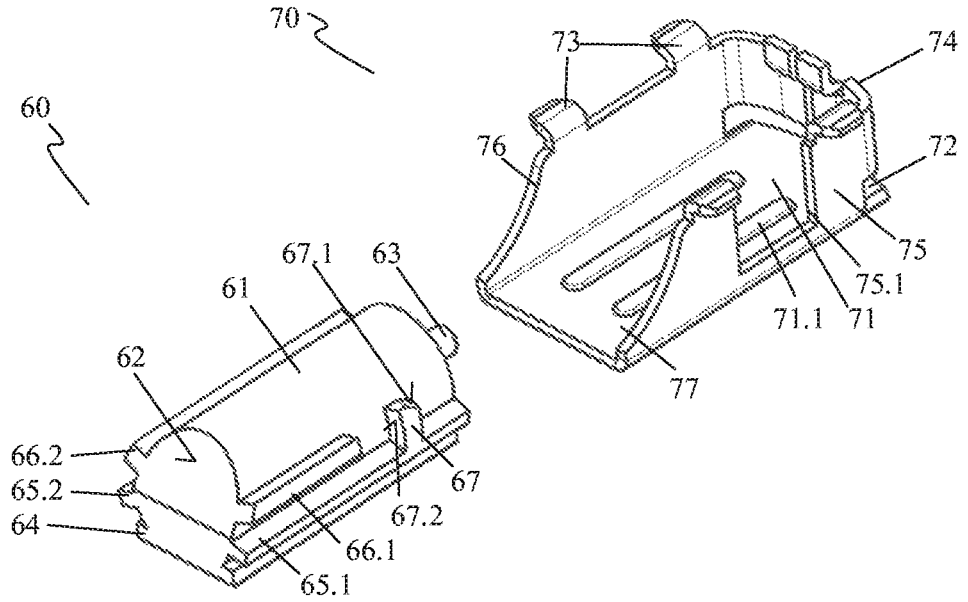
FIG. 16 is a perspective view of a linear damper having a housing.

FIG. 16 is a perspective view of a linear damper 60 with a housing 70.

With such a linear damper 60, as a result of a force acting axially on the linear damper 60, the piston 63 is inserted into the cylinder 61, wherein the damping action of the linear damper 60 occurs counter to the acting force. To this end, either the piston 63 or, as provided for in the present installation situation, the cylinder 61 can be moved.

The cylinder 61 is constructed substantially unilaterally in a cylindrical manner and is terminated opposite by a planar cylinder base 64. Laterally on the cylinder 61, a first lower guiding web 65.1 and with spacing therefrom a first upper guiding web 66.1 are formed. Opposite the first lower guiding web 65.1 and the first upper guiding web 66.1, a second lower guiding web 65.2 and a second upper guiding web 66.2 are arranged on the cylinder 61. The guiding webs 65.1, 65.2, 66.1, 66.2 are orientated along the longitudinal extent of the cylinder 61. At the end side and opposite the piston 63, the cylinder 61 has the inclination 62. At the side of the first lower guiding webs 65.1, the blocking attachment 67 is formed on the cylinder 61. The blocking attachment 67 is in this instance constructed in the manner of a web. It is orientated in the longitudinal extent thereof transversely relative to the longitudinal extent of the linear damper 60. In this instance, the blocking attachment 67 is formed in such a manner that it follows the curvature of the cylindrical outer face of the cylinder 61. At one end, the blocking attachment 67 merges into the first lower guiding web 65.1. At the opposite end thereof, the blocking attachment 67 has the attachment inclination 67.1. To this end, the blocking attachment 67 is constructed to be chamfered at the end in the direction toward the housing 70. Opposite the attachment inclination 67.1, the blocking attachment 67 forms the blocking counter-face 67.2. This is consequently arranged so as to face away from the housing 70. The surface normal of the blocking counter-face 67.2 is orientated in the movement direction of the linear damper 60.

The housing 70 has a housing base 71 on which two housing side walls 75, 76 are formed opposite each other. At the end side, the two housing side walls 75, 76 are connected to each other by means of a housing rear wall 74. The housing rear wall 74 terminates with spacing from the housing base 71. Between the housing rear wall 74 and the housing base 71, the spring receiving member 72 is thereby formed in the form of a gap. Opposite the housing rear wall 74 and facing the linear damper 60, the housing 70 is opened by a housing opening 77. Facing away from the housing base 71, the locking elements 73 are formed on the housing side walls 75. 76. The first housing side wall 75 is penetrated by a wall recess 75.1. It serves when the furniture hinge 1 is mounted to guide through the locking bolt 103.3 of the locking element 100 shown in FIG. 15. Through the housing opening 77, the linear damper 60 can be inserted into the housing 70. It then abuts with the piston 63 thereof the housing rear wall 74, whereby the piston is fixed in the position thereof. The cylinder 61 is with the furniture hinge 1 assembled supported so as to be able to be linearly adjusted on the housing base 71. For easy adjustment of the cylinder 61, the housing base 71 has base webs 71.1 which extend in the direction of the movement of the cylinder 61 and on which the cylinder 61 slides. The housing side walls 75, 76 are constructed to be laterally recessed with respect to the housing opening 77, starting from the housing base 71, to the opposite side thereof. The inclination 62 of the linear damper 60 is thus released, whilst the cylinder base 64 is at least supported to the greatest possible extent by the housing base 71, even when the linear damper 60 is pushed out.

Figure 17:
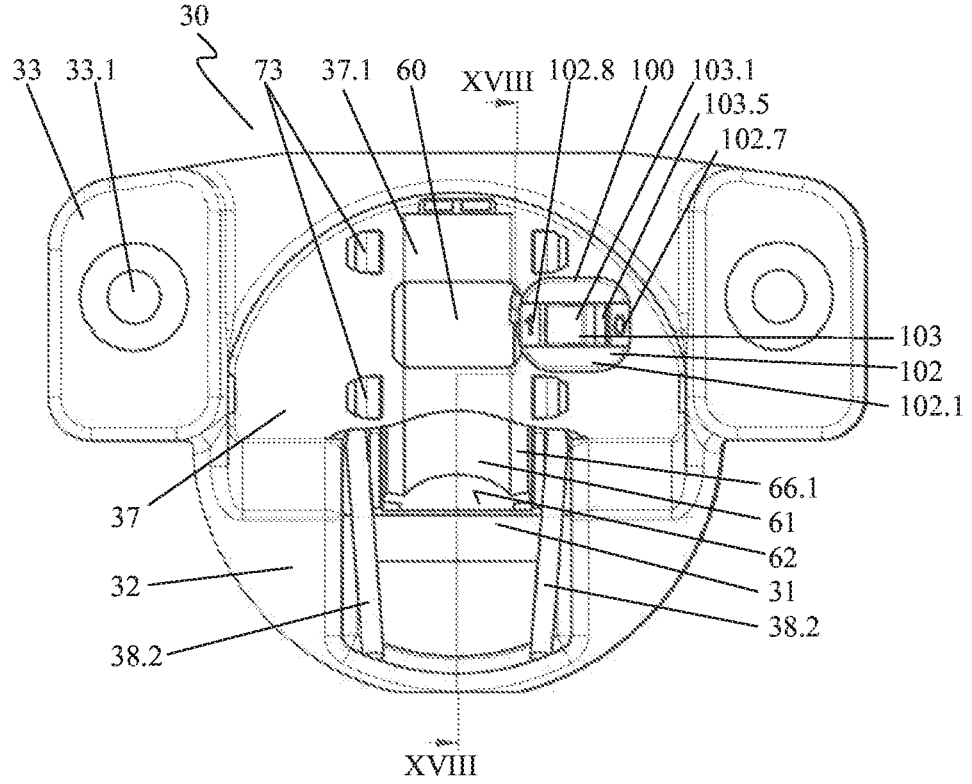
FIG. 17 is a plan view of a hinge cup of the furniture hinge.

FIG. 17 is a plan view of the hinge cup 30 of the furniture hinge 1, as has already been described with reference to FIGS. 6 to 9. The locking element 100 is inserted at the side of the linear damper 60 in a recess in the cover 37 of the hinge cup 30. In this instance, the locking element 100 abuts with the abutment flange 102.1 thereof shown in FIG. 15 the edge of the recess on the cover 37. As a result of the locking attachments 102.6 also shown in FIG. 15 on the locking element housing side walls 102.3, the locking element housing 102 is secured in the recess of the cover 37. The locking element 100 is orientated in such a manner that the rotation axis thereof, as described with reference to FIG. 15, is orientated in the movement direction of the linear damper 60. Consequently, the rotation axis is orientated in the direction of the longitudinal extent of the linear damper 60 or in the direction of the damping action of the linear damper 60.

In the illustration shown, the locking element 100 is positioned in its locking switching position 102.7. The handle 103.5 is consequently pushed in the direction toward the region of the abutment flange 102.1 marked with a 0. As a result of the locking device 102.9 shown in FIG. 15, the locking element 100 is secured with respect to unintentional displacement by a user. The handle 103.5 can be adjusted in a pivot movement about the rotation axis of the locking element 100 from the locking switching position 102.7 into the damping switching position 102.8. In this instance, the retention forces applied by the locking device 102.9 are overcome. In the damping switching position 102.3, the handle 103.5 abuts the abutment flange 102.1 at the side marked with a 1. In this position, it is locked by the locking device 102.9 again. The locking device 102.9 consequently ensures that the locking switching position 102.7 and the damping switching position 102.8 are in each case precisely adjusted and that unintentional displacement of the locking element 100 by a user is prevented.

When the handle 103.5 is adjusted, the locking element insert 103 is rotated about the rotation axis of the locking element 100. The locking bolt 103.3 shown in FIG. 15 is thereby also pivoted about the rotation axis. The locking bolt 103.3 can thus in the locking switching position 102.7 be moved into engagement and in the damping switching position 102.8 out of engagement with the blocking attachment 67 of the linear damper 60. As a result of the orientation of the rotation axis of the locking element 100 in the direction of the movement of the linear damper 60, the locking bolt 103.3 is in this instance pivoted inward and outward on a circular path which extends transversely relative to the movement direction of the linear damper into the adjustment region of the blocking attachment 67 of the linear damper 60. Preferably, the rotation axis is orientated in such a manner that the circular path on which the locking bolt 103.3 is moved is orientated perpendicularly to the movement direction of the linear damper 60. From the linear damper 60 and the blocking attachment 67 which is connected thereto, it is consequently not possible to transmit any force component acting in the adjustment direction of the locking element 100 to the locking bolt 103.3. It is thereby ensured, regardless of the action of the locking device 102.9, that the switching position 102.7, 102.8 of the locking element 100 is not adjusted unintentionally by the action of the linear damper 60. This applies in particular in the event of potential wear of the locking device 102.9 with repeated adjustment of the locking element 100.

Figure 18:
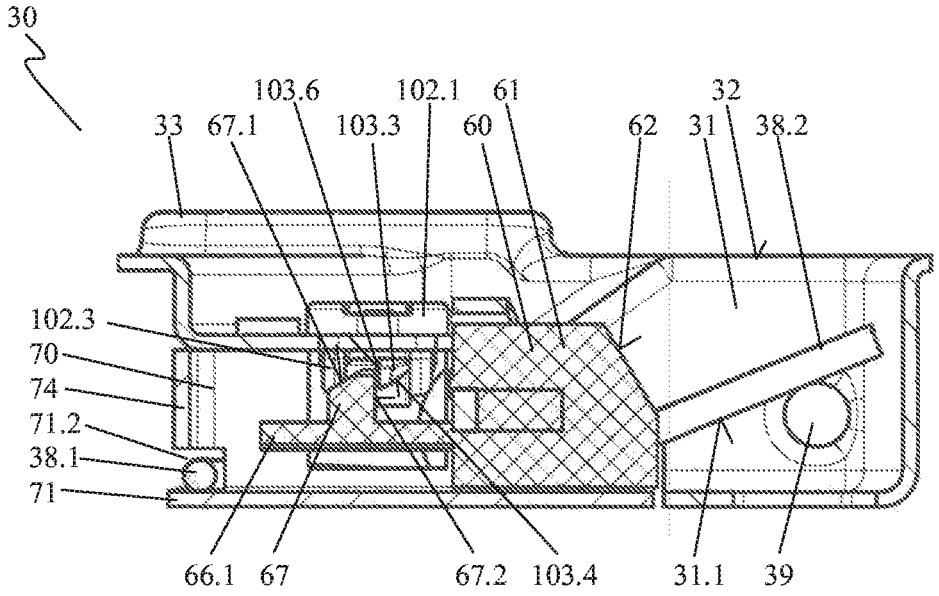
FIG. 18 is a lateral sectioned illustration of the hinge cup shown in FIG. 17.

FIG. 18 is a lateral sectioned illustration of the hinge cup 30 shown in FIG. 17. The section path extending at an angle is in this instance illustrated in FIG. 17 and indicated XVIII.

In the illustration selected in FIG. 18, the locking element 100 is adjusted into the locking switching position 102.7 thereof. The locking bolt 103.3 is consequently pivoted into the adjusted region of the blocking attachment 67. The linear damper 60 is located in this instance in the inserted position thereof. In the locking switching position 102.7 of the locking element 100 and the retracted position of the linear damper 60, the locking bolt 103.3 consequently abuts with the blocking face 103.6 thereof the blocking counter-face 67.2 of the blocking attachment 67. The linear damper 60 is thus as a result of accordingly acting restoring forces with the furniture hinge 1 open not adjusted into the extended position thereof. Consequently, the inclination 62 of the cylinder 61 is not pushed into the centering region 31 of the hinge cup 30 and consequently the adjustment path of the articulated lever 43 shown in FIG. 14. When the furniture hinge 1 is closed, the articulated lever 3 40 consequently does not abut the linear damper 60 over the entire adjustment region thereof. The closure movement of the furniture hinge 1 is therefore not damped by the linear damper 60. The blocking face 103.6 and the blocking counter-face 67.2 are orientated transversely relative to the movement direction of the linear damper 60. As a result of the orientation of the rotation axis of the locking element 100 in the movement direction of the linear damper 60, there is produced an adjustment of the locking bolt 103.3 in the plane of the blocking face 103.6 and the blocking counter-face 67.2. As a result of the restoring forces acting in the direction of the extended position of the linear damper 60 on the cylinder 61, consequently, no force component acting in the adjustment direction of the locking bolt 103.3 is transmitted thereto. Depending on the durability of the locking bolt 103.3 and the blocking attachment 67, the restoring forces can consequently be selected to be as large as desired without the locking element 100 thereby being unintentionally adjusted from the locking switching position 102.7 into the damping switching position 102.8 thereof.

By manually adjusting the locking element 100 from the locking switching position 102.7 into the damping switching position 102.8 thereof, the locking bolt 103.3 is pivoted out of the adjustment path of the blocking attachment 67. The blocking attachment 67 and consequently the cylinder 61 of the linear damper 60 are thereby released. The cylinder 61 can thus with the furniture hinge 1 open be adjusted by the acting restoring forces into the extended position thereof. The inclination 62 of the cylinder 61 is thereby pushed into the centering region 31 of the hinge cup 30 and consequently the adjustment path of the articulated lever 43 (see FIG. 14). When the furniture hinge 1 is closed, the articulated lever 43 presses in the last movement portion thereof against the inclination 62 of the linear damper 60 and pushes it together. The closure movement of the furniture hinge 1 and consequently of the furniture door 5, flap or the like is thereby damped.

In the assembled state, an adjustment of the locking element 100 can be carried out only with the furniture door 5, flap or the like open. Starting from a damping switching position 102.8 of the locking element 100, the cylinder 61 is first arranged in the deployed position thereof. When the locking element 100 is switched from the damping switching position 102.8 thereof into the locking switching position 102.7 thereof, the locking bolt 103.3 is pivoted at the side of the blocking attachment 67 opposite the blocking counter-face 67.2 into the adjustment path thereof. Consequently, the inclined start-up member 103.4 of the locking bolt 103.3 and the attachment inclination 67.1 of the blocking attachment 67 face each other. When the furniture hinge 1 is closed, the cylinder 61 of the linear damper 60 is pushed into the inserted position thereof. In this instance, the blocking attachment 67 slides along the attachment inclination 67.1 and the inclined start-up member 103.4 past the locking bolt 103.3. The locking bolt 103.3 is to this end constructed in a correspondingly resilient manner so that it can be displaced by the blocking attachment 67 sliding past by the required distance. When the inserted end position of the cylinder 61 is reached, the resilient locking bolt 103.3 is then adjusted into the tension-free position thereof again so that the blocking face 103.6 and the blocking counter-face 67.2 face each other.

The invention claimed is:

1. A furniture hinge for connecting a pivoted furniture part to a furniture carcass, the furniture hinge comprising:

a hinge cup configured to be secured to one of the pivoted furniture part or the furniture carcass;

an assembly member configured to be secured to the other of the pivoted furniture part or the furniture carcass;

a hinge arm pivotally connected to the hinge cup and configured to be connected to the assembly member such that the hinge cup is pivotable relative to the assembly member;

a linear damper configured to dampen at least a closure movement of the furniture hinge, the linear damper having a movement direction; and a locking element adjustable into at least two switching positions, one of the switching positions being a locking switching position in which the linear damper is blocked in a retracted position of the linear damper, and another of the switching positions being a released position in which the linear damper is free to extend, the locking element including a locking bolt pivotable about a rotation axis of the locking element into an adjustment region of the linear damper or a component connected to the linear damper to define the locking switching position, the locking bolt being pivotable about the rotation axis out of the adjustment region to define the released position, the rotation axis of the locking element being oriented parallel to the movement direction of the linear damper.

2. The furniture hinge of claim 1, wherein:

the locking element is configured to be moved between the switching positions by a human operator without the use of a tool.

3. The furniture hinge of claim 1, wherein:

the locking element includes a rotary member supported so as to be able to be rotated about the rotation axis, the locking bolt being secured to the rotary member, and the locking element includes a handle secured to the rotary member, the handle being angularly offset relative to the locking bolt about the rotation axis.

4. The furniture hinge of claim 3, wherein:

the locking element includes a locking element housing, a bearing pin supporting the rotary member in the locking element housing, and wherein the locking bolt and the handle extend through openings in the locking element housing.

5. The furniture hinge of claim 4, wherein:

the locking element housing includes at least one locking attachment configured to secure the locking element housing to the hinge cup.

6. The furniture hinge of claim 1, further comprising:

at least one locking device configured to lock the locking bolt in a selected one of the switching positions.

7. The furniture hinge of claim 1, wherein:

the locking bolt includes an inclined start-up member and a blocking face;

wherein with the locking element in the locking switching position and with the linear damper extended, the inclined start-up member faces the linear damper or the component connected to the linear damper; and wherein with the locking element in the locking switching position and with the linear damper retracted the blocking face faces the linear damper or the component connected to the linear damper.

8. The furniture hinge of claim 1, further comprising;

a blocking attachment secured to one of the cylinder and piston of the linear damper movable relative to the hinge cup, the blocking attachment including an attachment inclination and a blocking counter-face;

wherein with the locking element in the locking switching position and with the linear damper extended, the attachment inclination faces the locking bolt; and wherein with the locking element in the locking switching position and with the linear damper retracted the blocking counter-face faces the locking bolt.

9. The furniture hinge of claim 1, wherein;

the locking bolt is resilient at least in a pivoting direction about the rotation axis of the locking element.

10. The furniture hinge of claim 1, further comprising;

the hinge cup defining a cup interior, the hinge cup including an assembly region of reduced cup depth defined by a cover, the cover having a recess;

a housing positioned outside of the hinge cup and secured to an outer side of the cover;

the hinge arm pivoting through a pivot region of the cup interior of the hinge cup;

the linear damper being received in the housing and including a movably supported damper portion guided through an opening in the hinge cup into the pivot region of the cup interior of the hinge cup; and the locking element including a handle angularly offset relative to the locking bolt about the rotation axis, the locking element being secured in the recess of the cover with the handle of the locking element extending into the cup interior of the hinge cup and with the locking bolt extending outside of the hinge cup.

11. The furniture hinge of claim 10, wherein:

the housing includes a wall recess facing the locking element, and the locking bolt extends through the wall recess into the housing.

12. The furniture hinge of claim 1, further comprising:

a connection system configured such that the hinge arm can be indirectly or directly secured to the assembly member without the use of tools.

* * * * *